US006386986B1

(12) United States Patent
Sonner et al.

(10) Patent No.: US 6,386,986 B1
(45) Date of Patent: May 14, 2002

(54) CHILD SWING

(75) Inventors: Robert J. Sonner, South Wales, NY (US); Chinawut P. Paesang, North Attleborough, MA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/849,241

(22) Filed: May 7, 2001

(51) Int. Cl.[7] ..... A63G 9/16

(52) U.S. Cl. ..... 472/119; 472/118; 5/102; 5/109; 297/273

(58) Field of Search ..... 472/118, 119; 5/93.1, 99.1, 101, 102, 103, 108, 109; 297/273, 274

(56) References Cited

U.S. PATENT DOCUMENTS

| | | | | |
|---|---|---|---|---|
| 146,069 | A | | 12/1873 | Harris |
| 237,820 | A | | 2/1881 | Clark |
| 594,015 | A | | 11/1897 | Homer |
| 803,838 | A | | 11/1905 | Mellen |
| 860,156 | A | | 7/1907 | Scalf |
| 1,227,984 | A | | 5/1917 | Vanderburgh |
| 1,266,927 | A | | 5/1918 | Eberle |
| 1,282,927 | A | | 10/1918 | Paskal |
| 1,439,619 | A | | 12/1922 | Dziedzic |
| 1,458,049 | A | | 6/1923 | Grieshaber |
| 2,517,207 | A | | 8/1950 | Hugueny |
| 2,524,967 | A | | 10/1950 | Ellis |
| 3,806,117 | A | | 4/1974 | Foster |
| 3,837,019 | A | | 9/1974 | Hoff |
| 4,065,175 | A | | 12/1977 | Perego |
| 4,150,820 | A | | 4/1979 | Bochmann |
| 4,240,625 | A | | 12/1980 | Meeker |
| 4,271,627 | A | | 6/1981 | Echterling |
| 4,324,432 | A | | 4/1982 | Eldon, III et al. |
| 4,452,446 | A | | 6/1984 | Saint |
| 4,491,317 | A | | 1/1985 | Bansal |
| 4,589,657 | A | | 5/1986 | Saint |
| 4,697,845 | A | | 10/1987 | Kamman |
| 4,807,872 | A | | 2/1989 | Spilman et al. |
| 5,113,537 | A | | 5/1992 | Turk |
| 5,348,374 | A | | 9/1994 | Kuo |
| 5,525,113 | A | | 6/1996 | Mitchell et al. |
| 5,542,151 | A | * | 8/1996 | Stranski et al. ..... 16/326 |
| 5,553,337 | A | | 9/1996 | Lin |
| 5,562,548 | A | | 10/1996 | Pinch et al. |
| 5,708,994 | A | | 1/1998 | Chandran |
| 5,788,014 | A | | 8/1998 | Saint et al. |
| 5,833,545 | A | | 11/1998 | Pinch et al. |
| 5,951,102 | A | | 9/1999 | Poulson et al. |
| 5,975,631 | A | | 11/1999 | Fair et al. |
| 6,022,277 | A | | 2/2000 | Jankowski |
| 6,059,667 | A | * | 5/2000 | Pinch ..... 297/273 |
| 6,319,138 | B1 | | 11/2001 | Fair et al. ..... 472/119 |

OTHER PUBLICATIONS

"Battery Operated Swing", Product No. 9122, Fisher–Price Juvenile Products 1992, p. 13, 1991 (3 pages total). Drawing of Product No. 9122 motor/drive system.

* cited by examiner

*Primary Examiner*—Kien T. Nguyen
(74) *Attorney, Agent, or Firm*—Morgan, Lewis & Bockius, LLP

(57) ABSTRACT

A child swing provides a child support that is supportable by a support frame. The child swing may be configured between a stowed and deployed configuration by providing a collapsible child support and a folding support frame. The collapsible child support may include collapsible hangers and a collapsible child receptacle. Frame members of the frame can be connected by hinges which allow a user to conveniently fold the frame into a compact position such that the folded frame may then be placed in the child support. The child support may be driven by an electric motor mounted to the support frame. A periodic motion output from the electric motor may be transferred to swinging motion of the child support by connecting a hanger arm to a post of the support frame which is coupled to the electric motor. In the preferred embodiment, a releasable latch is used to retain the hanger arm to the post. A coupling between the support frame and child support provides a user with a readily accessible device for converting the swing between deployed and stowed configurations.

49 Claims, 15 Drawing Sheets

CHILD SWING

The invention relates broadly to a child's swing and more particularly, to a portable, self-supporting child's swing.

BACKGROUND OF INVENTION

There are a wide variety of self-supporting child's swings known in the art, the most common of which consist of a child support pivotally secured to a support structure. The pivoting motion is provided by either manual excitation, or by rotational input supplied by a wound spring or an electric motor. In the case of a child's swing powered by an electric motor, the most common design is described by an output shaft of a rotary motor being torsionally and/or pivotally coupled to structure corresponding to the child support side of the child's swing. That is, the child support is mechanically coupled to the output shaft of the motor, whether it be directly, through a gear train, linkage or a combination thereof. In order to remove the child support from the support structure or, alternatively, when assembling the swing, the known swings require the use of tools and/or removable fasteners (e.g., screws, bolts, pins) in order to secure the child support to support bearings and/or the output portion of the motor assembly.

Portable child swings, that is, child swings constructed with a view towards providing the user (e.g., a consumer) with a device that may be stowed and deployed are known in the art. However, the known portable child swings typically have limited features and/or are unnecessarily complicated when assembling or disassembling, as they often times require the use of removable fasteners and/or the removal and reattachment of components which can be easily lost. Furthermore, the known portable child swings are often times less than optimally designed for storage in a reduced-volume storage space.

In view of these and other drawbacks and/or disadvantages in the known child swings, there exists a need for providing a self-supporting child's swing that is easily configured between a stowed and deployed configuration without the need for disassembly and/or re-assembly of components; a child's swing that is durable, easy to manufacture and easy to use by a consumer; and a child's swing that is compact and yet provides many of the features found in the more complicated and cumbersome child swings known in the art.

SUMMARY OF INVENTION

The needs identified above are met, and the shortcomings of prior art child swings are overcome by the child swing of the invention. In one aspect, there is provided a swing including a child support adapted for being rotated about an axis of rotation, a support frame including first and second upstanding frame portions for supporting the child support, a first coupling providing periodic motion output supplied by a motor drive assembly to the child support, the first coupling including a bearing member of the motor drive assembly and a mating member, wherein the child support is supported upon the first frame portion by engagement of a portion of a bearing member surface with a corresponding portion of a mating member surface, wherein when the child support first end is supported upon the first frame portion, the mating member is adapted for being rolled about the bearing member so as to displace the mating member along a displacement axis relative to the bearing member, the displacement axis being perpendicular to the rotation axis; and a second coupling for supporting the second end upon the second frame portion; wherein when the motor drive assembly produces periodic output at the bearing member, the child support rotates about the rotation axis by the rolling of the mating member about the bearing member. The bearing member is preferably mechanically decoupled from the mating member and relies on a frictional engagement with the bearing member to cause the swing to rotate about the rotation axis. A tacky material, e.g., rubber, may be used to facilitate a frictional contact between the mating and bearing surfaces. The bearing member may be circular in shape and the mating member may also describe a circle or an arc of a circle. Thus, the bearing and mating surfaces may describe contacting surfaces of circular-like or cylindrical-like bodies. The swing of this aspect of the invention may also include a releasable latch for releasably connecting the child support from the support structure.

In another aspect of invention, there is provided a self-supporting child's swing configurable between a storage and use position. The self-supporting child's swing includes a frame configurable between a folded position and an unfolded position, the support frame including a ground engaging portion, a first frame portion and a second frame portion, each of the frame portions being fixedly hinged to the ground engaging member, and a first and second housing, wherein the first and second frame portions are configurable in a first and second orientation relative to the ground-engaging member when the frame is in the unfolded and folded positions, respectively; and a child support having a child support surface and describing a child receiving end, the child support being configurable between a deployed and stowed position, the child support including an annular support member defining an outer perimeter of the child receiving end and first and second terminal ends of the child support, a first connector and a second connector disposed at the respective first and second ends, and a child receiving portion secured to the support member, the child receiving portion including retaining walls and the child support surface, wherein when the child support is in the deployed position, the support surface is disposed below the support member and the child support surface is contained within the retaining walls, and wherein when the child support is in the stowed position, the child support surface and the support member lie within approximately the same plane; wherein when the self-supporting child's swing is in the use position, the child support is suspended from the first and second frame housings by the respective first and second connectors of the child support, the child support is in said deployed position, and the frame is in the folded position, and wherein when the self-supporting child's swing is in the storage configuration, the child support is configured in the stowed position, the frame is in the folded position and the folded frame is contained substantially within the child receiving end.

In still another aspect of invention, there is provided a child's swing including a child support supportable on a support frame; a first and second connecting arm for supporting the child support from the support frame, each of the connecting arms including a proximal end coupled to the child support and a distal end adapted for being connected to the support frame; a latch disposed on either the first connecting arm distal end or the support frame, the latch including a blocking piece movable between an engaged and disengaged position; wherein when the blocking piece is in the engaged position, the first connecting arm distal end forms an interference fit with a first mounting member of the frame, the interference fit preventing inadvertent removal of the distal end from the first mounting member when the child support rotates. The interference fit may be utilized so as to allow the distal end of the connecting arm to be removed while a motor drive for the swing is in operation, as well as providing a convenient connection device between the connecting arm and support frame. A self-locking latch may be used to enable or disable the interference fit, and the swing may include a second latch, identical to the first, which may also be disposed on either the second connecting arm distal end or the support frame.

In still another aspect of invention, there is provided a method for configuring a child's swing between a use and storage position, including the steps of removing the first arm of a child support from a first end of a support frame, removing the second arm of the child support from the second end of the support frame, folding the frame, collapsing the child support, and placing the folded frame within the child support.

In still another aspect of invention, there is provided a child support suspendable from a support frame by first and second connecting arms that are pivotably coupled to the child support so as to enable the connecting arms to be configurable between a deployed position wherein the connecting arms extend upwardly from the child support and a stowed position wherein the connecting arms lie within the child support. In this embodiment, the connecting arms may also include first and second self-locking latches disposed at the distal ends of the connecting arms for securing the connecting arms to the support frame.

In another aspect of invention, there is provided a child support device which may be configured to a compact storage position to thereby provide a parent with a readily portable child support device. The support device of this aspect of invention may also be configured as a swing operated by an electric motor.

In a further aspect of invention there is an approach for assembly of a child's swing which requires a simple engagement of self-locking latches disposed on connecting arms of the child support with end portions of a support frame. In this aspect of the invention, the latches securing the connecting arms to the frame ends may be easily disengaged by manually opening the latch with finger pressure. This aspect of the invention provides a child's swing which does not require a user to secure fasteners, remove housings or engage in other labor-intensive activities when configuring the swing between a use and storage configuration.

In another aspect of invention, there is provided a swing driven by an electric motor which provides an enhanced parent-to-child interactive environment and, in particular, a swing which provides the parent with an ability to control swing motion according to the child's needs. For example, the swing allows one to control the swing motion while the motor is energized and is providing periodic motion to an output end. The parent can either remove the child support from the output end of the motor drive, assist the motor with the swinging motion, or simply block swinging motion, all while the motor drive remains engaged. This aspect of the invention is preferably implemented by utilizing an interference fit between the output end of the motor drive assembly and the child support connecting arm. The electric motor may also be adjustable by providing a power control which allows a parent to adjust motor output if, e.g., a heavier child is placed in the swing, or if a greater swing arc or extended swing period is desirable.

Additional features and advantages of the invention will be set forth or be apparent from the description that follows. The features and advantages of the invention will be realized and attained by the structures and methods particularly pointed out in the written description and claims hereof as well as the appended drawings.

It is to be understood that both the foregoing general description and the following detailed description are exemplary and explanatory and are intended to provide further explanation without limiting the scope of the invention as claimed.

BRIEF DESCRIPTION OF THE DRAWINGS

The accompanying drawings, which are included to provide a further understanding of the invention, are incorporated in and constitute a part of this specification, illustrate preferred embodiments of the invention and together with the description serve to explain the principles of the invention. In the drawings.

DETAILED DESCRIPTION OF THE PREFERRED EMBODIMENTS

The child swing of the invention is preferably implemented as swing 10 including a child support 20 supported by a frame 200, examples of which are illustrated in FIGS. 1–18.

Figure 1:
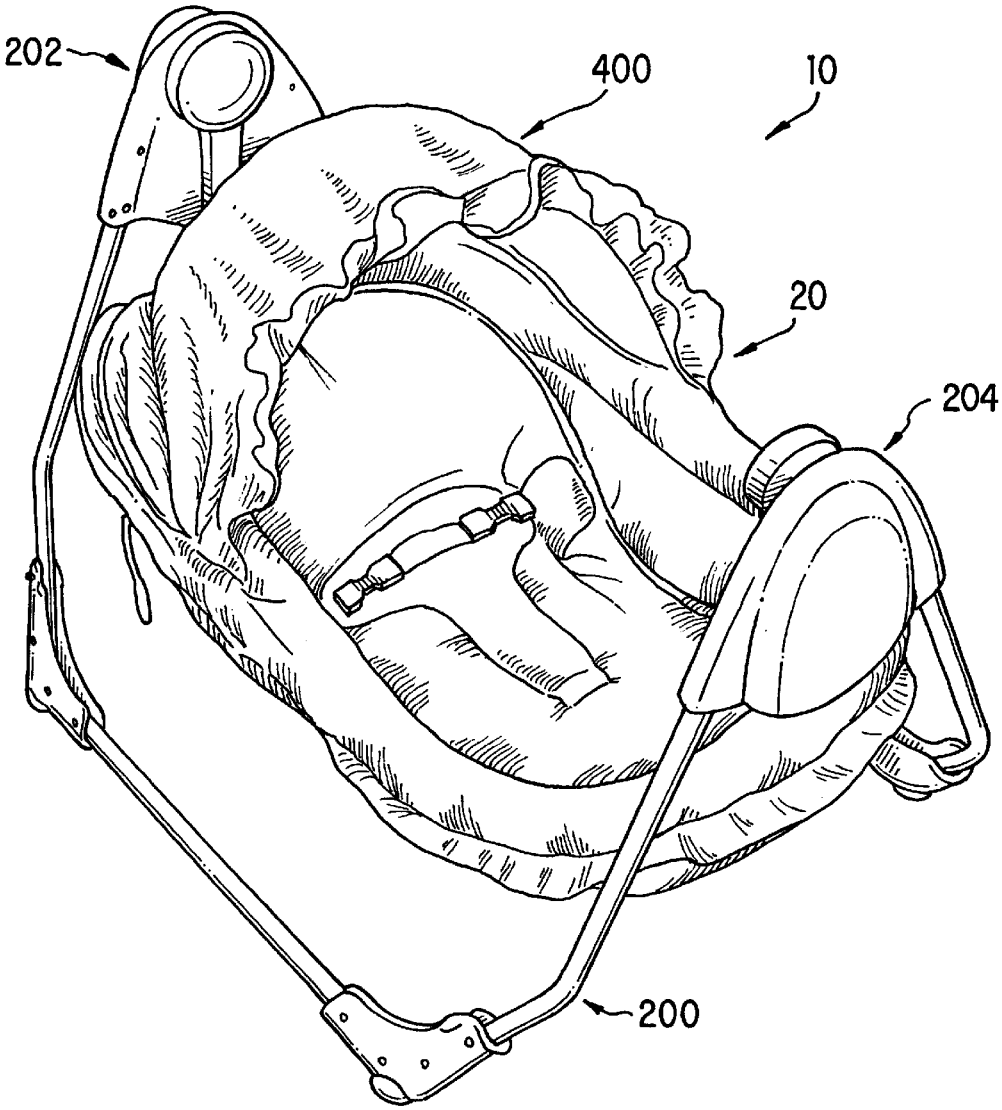
FIG. 1 is a first perspective view of a first embodiment of a swing made in accordance with the principles of invention.
Figure 2:
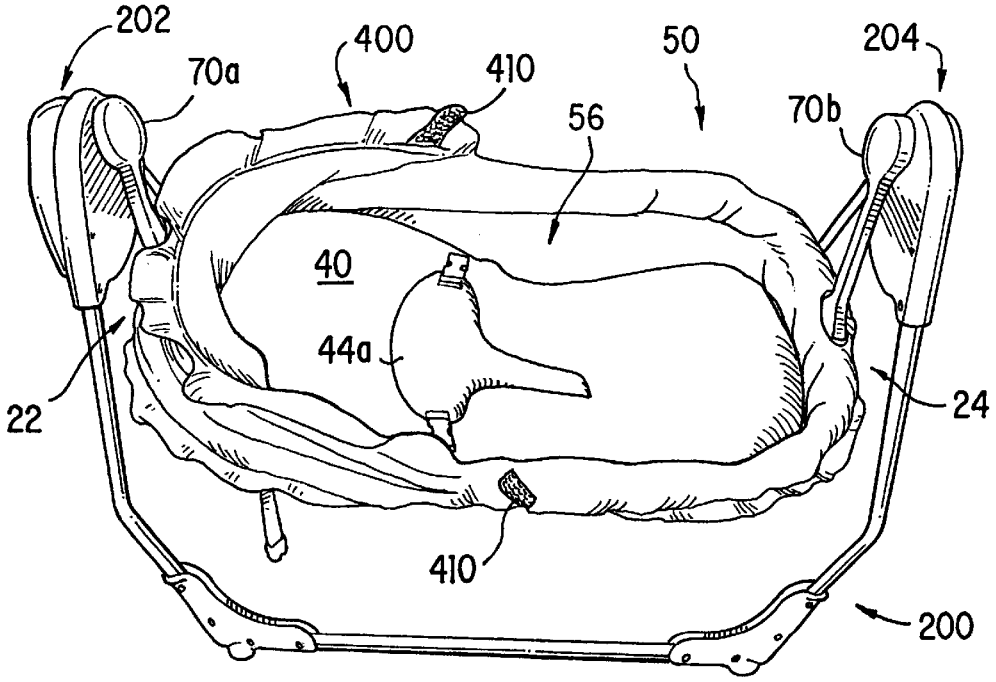
FIG. 2 is a second perspective view of the swing of FIG. 1.

Referring to FIGS. 1 and 2, child support 20 includes a left hanger 70*a* and right hanger 70*b* disposed at a head end 22 and foot end 24, respectively of child support 20. Left and right hangers 70*a*, 70*b* are adapted for supporting child support 20 from left and right upstanding frame portions 202, 204 of frame 200. In the preferred embodiment, swing 10 is powered by an electric motor which imparts periodic input to child support 20 so as to cause child support 20 to rock about left and right frame portions 202, 204.

Swing 10 is preferably configured to support child support 20 at head and foot ends, 22, 24, so as to provide a side-to-side rocking motion to a child placed therein. Swing 10 may alternatively be configured to provide a front-to-back rocking motion of child support 20, e.g., by placing hangers 70*a*, 70*b* at the sides of child support 20.

Figure 3:
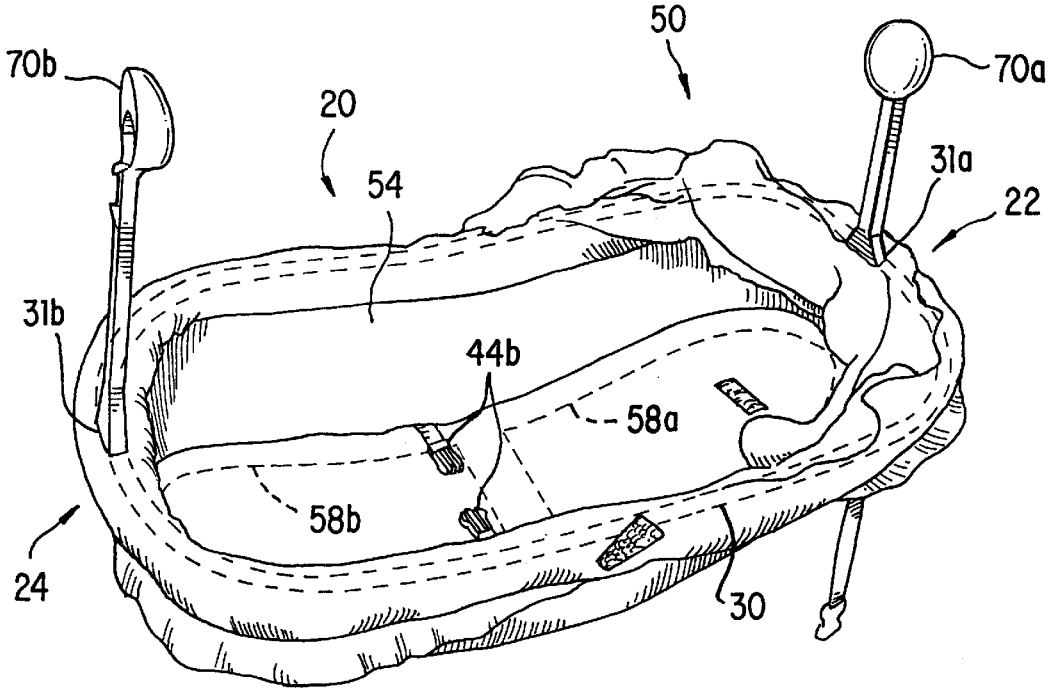
FIG. 3 is a perspective view of a child support of the swing of FIG. 1 with a soft goods padding removed.
Figure 5:
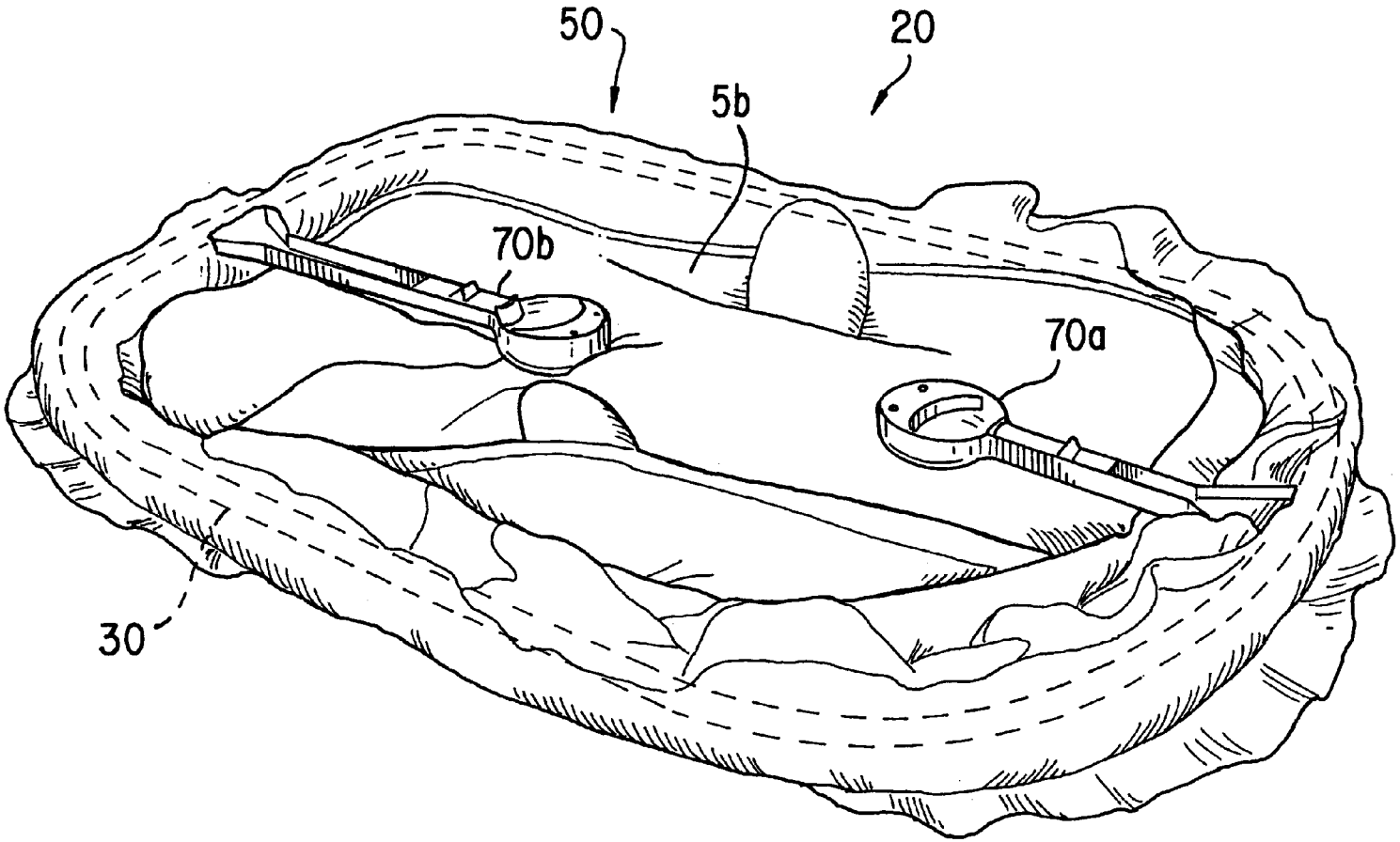
FIG. 5 is a perspective view of the child support of FIG. 3 in a compact position.

Referring to FIG. 3, child support 20 is preferably configured as a collapsible child support, configurable between a deployed position, FIGS. 1–3, and a compact position, FIG. 5, to facilitate storage of swing 10 when not in use. Referring to FIG. 2, child support 20 includes a child receptacle 50 defining a support portion 56 for a child placed in child support 20, and a rim 30 (as shown in phantom in FIG. 3), preferably elliptical in shape, which supports child receptacle 50. Rim 30 is preferably formed from a metal tube. Rim 30 has first and second ends 31*a*, 31*b* which receive left and right hangers 70*a*, 70*b*. A removable soft goods pad 40 can be provided for added comfort to the child. A restraint harness can be provided to restrain a child in child support 20 and includes a first portion 44*a*, fixed to pad 40, and a second portion 44*b* fixed to support portion 56. A similar pad, harness and a use of pad and harness in connection with a if child support is described in U.S. Pat. Nos. 6,095,614 and 5,947,552, herein incorporated by reference in their entirety.

FIG. 3 is a perspective view of child support 20 with pad 40 and first portion 44*a* of the restraint harness removed. Child receptacle 50 is preferably formed from a fabric material and includes side walls 54 extending about the perimeter of support portion 56. An upper sleeve 52 is formed to secure child receptacle 50 to rim 30 by stitching the fabric material over rim 30, or alternatively, by using releasable snaps, rivets, or buttons. Any of these approaches may be used to secure receptacle 50 to rim 30, provided that receptacle 50 is adequately secured to rim 30 when a child is placed on support surface 56. Support portion 56 is preferably formed with upper and lower batten 58*a*, 58*b* enclosed in fabric sleeves.

Figure 4A:
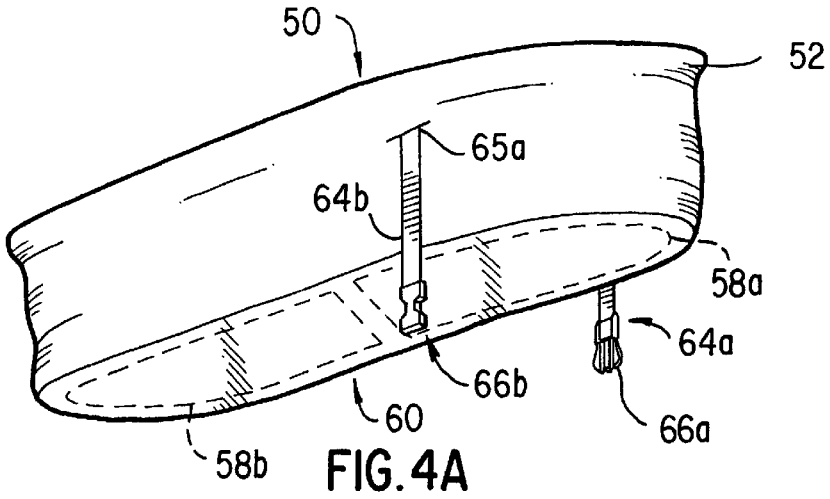
FIGS. 4A and 4B are rear perspective views of the child support of FIG. 3 configured in a reclined and upright position, respectively.
Figure 4B:
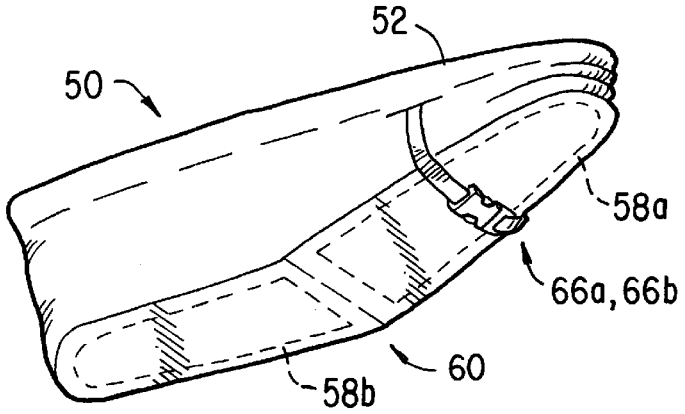
Figure 4C:
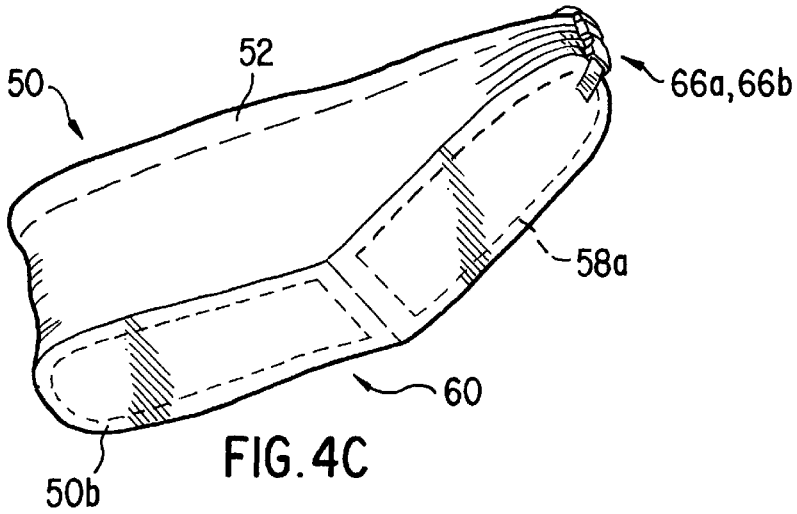
FIG. 4C is a rear perspective view of another embodiment of the child support configured in an upright position.

The fabric extending between, and connecting upper batten 58*a* and lower batten 58*b* forms a living hinge. With this arrangement, child support 20 may be reconfigured to provide an upright or reclined support surface for the child, e.g., a seat or bed position. FIGS. 4A and 4B show upper batten 58*a* in a reclined position (FIG. 4A) and an upright position (FIG. 4B) relative to lower batten 58*b*. Preferably, upper batten 58*a* is securable in the upright position by engaging a male and female buckle 66*a*, 66*b* disposed near the rear face 60 of child support 20. Male and female buckle 66*a*, 66*b* are disposed at the distal ends of webbings 64*a*, 64*b*. The proximal ends of webbings 64*a*, 64*b* are preferably secured to child support 20 at side locations 65*a*, 65*b* by stitching. When buckles 66*a*, 66*b* are engaged, webbings 64*a*, 64*b* cause side walls 54 to become taught, which results in batten 58*a* being supported at a more inclined position relative to lower batten 58*b* than when buckles 66*a*, 66*b* are disengaged. This approach for configuring from a reclined, to upright support is similar to the backrest support described in U.S. Pat. Nos. 5,660,435 and 5,947,552. In an alternative embodiment, webbing 64*a* may be secured at a location proximate the upper end of upper batten 58*a* and webbing 64*b* may be secured at an upper end proximate sleeve 52, as illustrated in FIG. 4C. One, two or any combination of fastener pairs may be used to provide the reclining seatback described above, depending on needs.

A collapsible canopy 400 can be provided with child support 20. Canopy 400 includes a soft goods cover supported through flexible ribs. In the deployed position, FIG. 1, canopy 400 is secured at its ends by hook and loop fasteners 410. Canopy 400 of the preferred embodiment is similar to that described in U.S. Pat. No. 5,947,552.

Child Support 20 may be easily configured as a collapsed child support when removed from frame 200. It is preferred to construct child receptacle 50 using soft goods (e.g., fabric) since side walls 54 will collapse under the weight of child support 20, thereby providing a collapsible child support 20. When configured in the collapsed position, hangers 70*a*, 70*b*, which are rotatably coupled to rim 30 (as discussed in more detail below), may be placed within rim 30, thereby providing a more compact device with hangers, 70*a*, 70*b*, rim 30, and suspension portion 50 all lying within substantially the same plane. Such a configuration is illustrated by example in FIG. 5.

Other types of collapsible child supports may be used in place of child support 20 without departing from the scope of invention. For example, any suitably constructed child support that is adapted for being suspended from frame 200 by hangers 70*a*, 70*b* or similar structure, as will be explained below, may be used in place of child support 20. If it is desirable to use a collapsible child support without using a fabric material for supporting the child, one may be constructed by, e.g., forming a frame having frame members connected by hinges that may be folded down to form a substantially planar, compact position or an alternative compact position, as desired. In still another embodiment, hangers 70*a*, 70*b* may be releasably received on annular rim 30, thereby providing a user with the option of removing hangers 70*a*, 70*b* from child support 20 when child support 20 is not used in connection with frame 200, or to facilitate storage of child support 20 when not in use. Child Support 20 may alternatively by folded lengthwise, if desired, by providing, e.g., a hinge connection between ends 31*a*, 31*b* of rim 30. Child support 20 may also be folded head to foot by, e.g., forming rim 30 from opposed U-shaped tubes which are either hinged to each other or releasably connected to each other.

Child support 20 may also be configured to provide lateral supports to a child placed in child support 20 as in, for example, the lateral support adjustment described in U.S. Pat. No. 5,947,552 which is operative for providing a lateral head restraint when the seatback is inclined using a pair of connecting straps.

Although the aforementioned child support 20 is preferably constructed using soft goods for child receptacle 50, child support 20 may also include a relatively rigid shell, or other relatively non-collapsible child receptacle (e.g., a plastic shell), if it is desirable to provide, e.g., a more rugged child receptacle. Such an embodiment is considered within the scope of invention since the various other aspects of the invention mentioned earlier, and as will now be discussed in greater detail by reference to an exemplary embodiment, may alternatively be implemented using a relatively rigid shell describing either an upright seat or child support.

Figure 6:
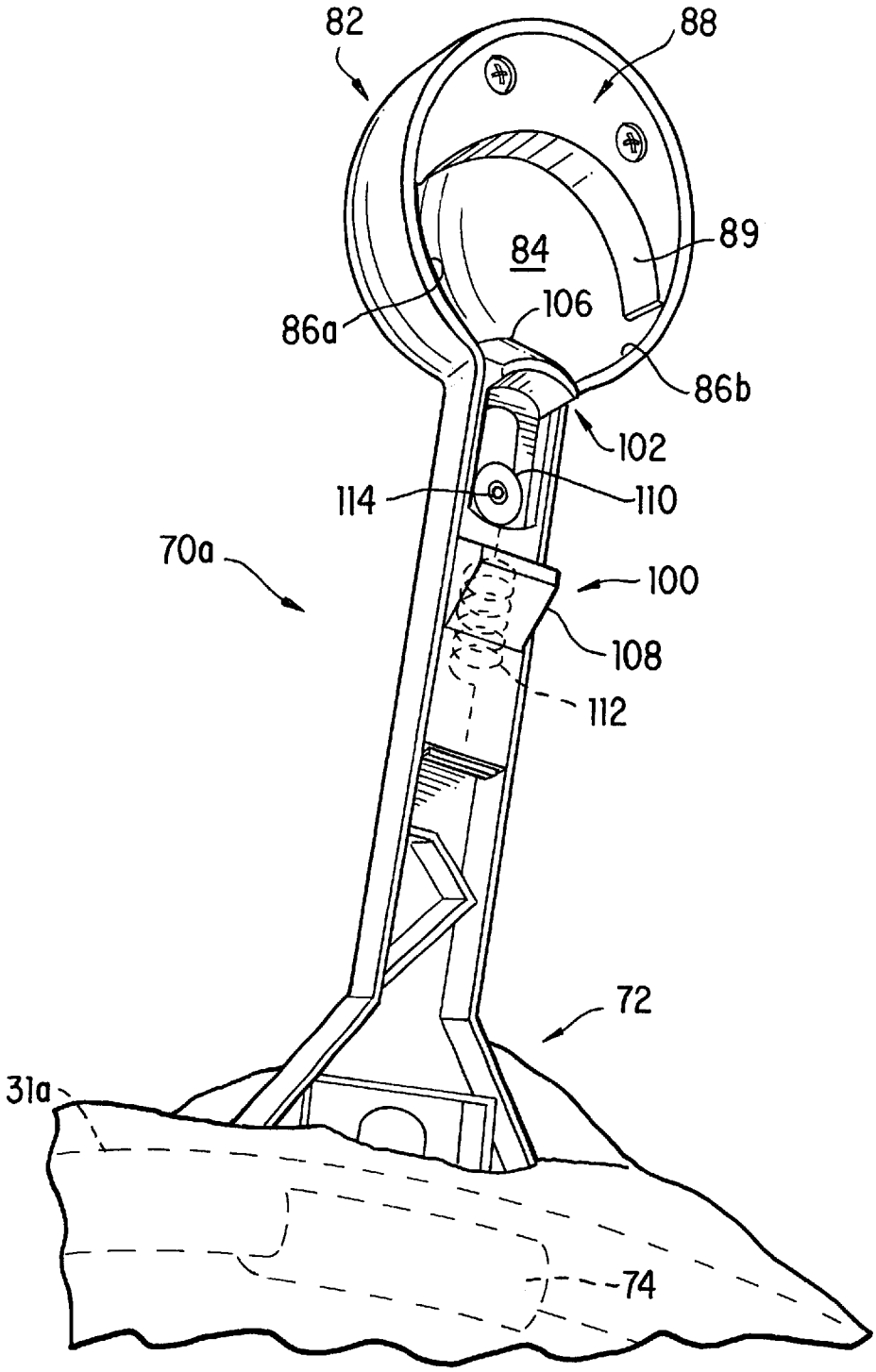
FIG. 6 is a perspective view of a hanger of the child support of FIG. 3.

Each of hangers 70*a*, 70*b* is preferably identical to each other. Reference will therefore be limited to hanger 70*a* with the understanding that the same description applies to hanger 70*b* unless stated otherwise. Referring to FIG. 6, hanger 70*a* includes a sleeve 74 disposed at a proximal end 72 thereof, and a cap 82 formed at a distal end 80 thereof. End 31*a* of rim 30 is received in sleeve 74. Rim 30, preferably formed from a circular tube, rotates freely within sleeve 74, thereby allowing hanger 70*a* to be pivotable relative to annular rim 30. As mentioned above, this arrangement permits hanger 70*a* to be positioned between an upright, extended position, FIGS. 1–3, and a folded position, FIG. 5. Alternatively, hangers 70*a*, 70*b* may be releasably engaged with rim 30 by using a suitably constructed latch for connecting hangers 70*a*, 70*b* to rim 30. In such an embodiment, it is contemplated that a child support (or similar child support) may be provided with hangers that can be coupled either at the head and foot ends, or at the sides of the child support if it is desired to provide a swing with either front-to-back or side-to-side swinging motion.

Figure 7A:
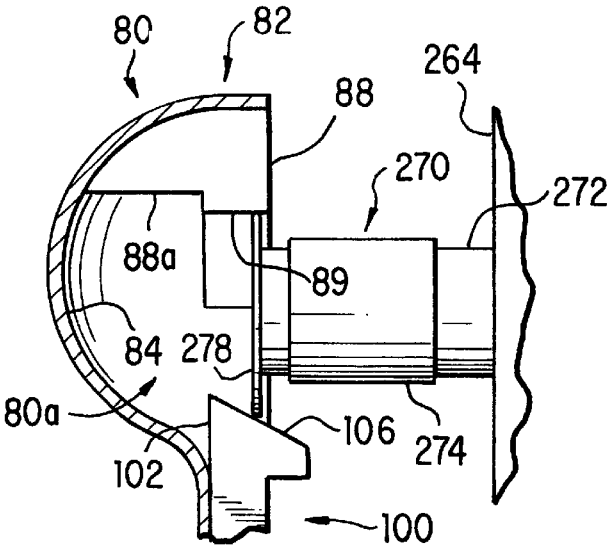
FIGS. 7A, 7B, 7C and 7D are plan views of a distal end of the hanger of FIG. 6 with and without a post of the frame of the swing of FIG. 1.
Figure 7C:
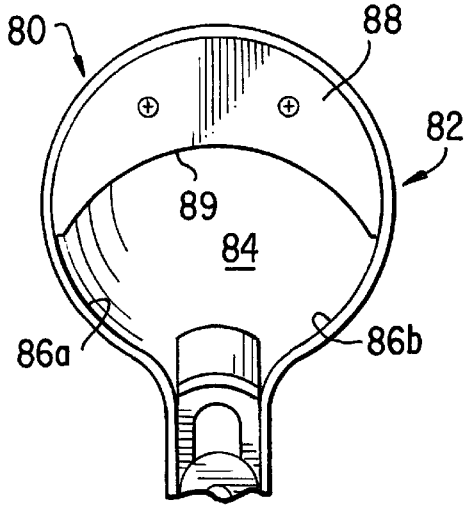
Figure 7B:
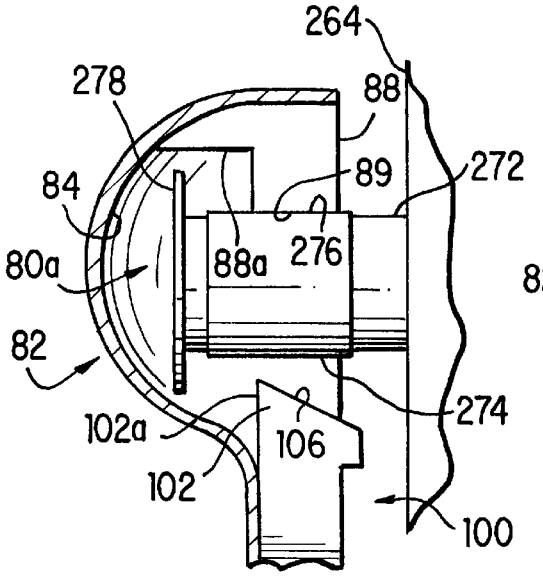
Figure 9:
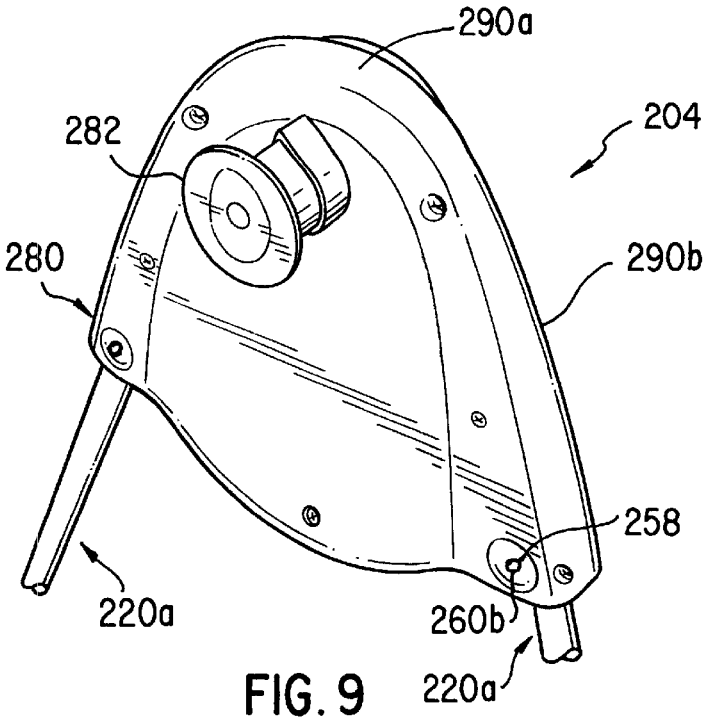
FIG. 9 is a perspective view of a right panel of the frame of FIG. 8.

Referring to FIGS. 6, 7A–7D, and 9–10, distal end 80 of hanger 70*a* includes cap 82, an arc member 88, and a latch 100 which cooperate to form a releasable connection between hanger 70*a* and left post 270 of left frame portion 202 (in similar fashion, hanger 70*b* includes an arc member, cap and a latch for releasably connecting hanger 70*b* to right post 282 of right frame portion 204, FIG. 9). Cap 82 is preferably formed as a hollow, hemispherical-shaped piece describing a spherical-like inner wall 84. Distal end 80 preferably includes an arc-shaped member 88 secured adjacent to an upper end of the outer wall of cap 82, by a pair of fasteners. The lower end of member 88 is described by a curved surface 89. Latch 100 is disposed below and adjacent to cap 82. A locking portion 102 is formed at the upper end of latch 100. When latch 100 is in the closed position, FIGS. 7B and 7D, locking portion 102 extends into an opening described by walls 86*a*, 86*b* and curved surface 89, and when latch 100 is in the open position, FIG. 7C, locking piece 102 is removed from this opening to permit insertion or removal of the terminal end of post 270 into a space 80*a* described by wall 84, inner wall 88*a* of member 88, and a rear surface 102*a* of locking portion 102, as shown in FIG. 7B. Latch 100 is adapted for being slidable along the lengthwise direction of hanger 70*a* between the closed position and the open position, guided by a slot 110 receiving a bolt 114 secured to hanger 70*a*. When positioning latch 100 in the open position, locking portion 102 is displaced downwardly against a compression spring 112 biasing latch 100 in the closed position, FIGS. 6, 7B and 7D. A finger tab 108 is formed on latch 100 to facilitate displacement of locking portion 102 downward by finger pressure applied to finger tab 108. Finger tab 108 is used to open latch 100 when the terminal end of post 270 is to be removed from space 80*a*. When post 270 is to be inserted into space 80*a*, the terminal end of post 270, which includes a flange 278, is pressed against a sloped outer surface 106 of locking portion 102 to cause latch 100 to be displaced downwardly and into the open position. Sloped surface 106 acts as a cam, allowing post 270 to open latch 100 by applying pressure to sloped surface 106. Referring to FIGS. 7A and 7B, as cap 82 is pressed into post 270, flange 278 of post 270 engages sloped surface 106, causing locking portion 102 to displace downwardly until flange 278 is clear of locking portion 102. Once clear of locking portion 102, the terminal end of post 270 (including flange 278) is contained in space 80*a* of cap 82, locking piece 102 is released by action of spring 112, and latch 100 is moved to the closed portion. As can be seen in FIG. 7B, flange 278 will prevent distal end 80 from being removed from post 270 when latch 100 is closed since flange will abut against locking portion 102 and member 88 if hanger 80 is pulled away from post 270.

When the terminal end of post 270 is contained in space 80*a* and latch 100 is in the closed position, the distal end 80 of hanger 70*a* is retained on post 270. After the distal end of hanger 70*b* is coupled to post 282 of right frame portion 204 in the same manner as described above, child support 20 is secured to frame 200. It is not necessary to utilize the same coupling structure at both left frame portion 202 and right frame portion 204 in order to practice the invention. However, the preferred embodiment is exemplary of a swing assembly of the invention since several advantages are realized. Advantages include a simplicity in design, a reduction of dissimilar parts in swing 10, and a user friendly assembly and disassembly procedure. Alternative couplings for releasably securing hangers 70*a*, 70*b* to frame portions 202, 204 are contemplated. In the preferred embodiment, post 282 and post 284 are permanently connected to panels 280 and 250 and hangers are releasably received on posts 282, 284. However, connecting posts may alternatively be permanently and rotatably connected to child support 20. In this embodiment, child support 20 may be releasably securable to the frame panels by providing a connector on posts for connecting the posts to a supporting frame when the swing is assembled. As will be explained in greater detail below, right post 282 can be fixed to panel 280 of right frame portion 204 whereas left post 270 is coupled to a drive shaft of a drive assembly, FIG. 17, to induce rocking motion of child support 20. Thus, when child support 20 rocks back and forth during use, hanger 70*b* preferably rocks about a stationary, right post 282. In an alternative embodiment which employs a rotary mechanism built into the hanger distal ends (e.g., posts 270 and 282 are permanently retained in the distal ends of hangers 70*a*,70*b* which are then connected to panels of the supporting frame during assembly), the stationary post could, for example, be snap-fit to the corresponding frame portion and the rotary or motion inducing post could be coupled directly to the output shaft, linkage or gear train associated with a motor drive. It is contemplated that a latch which is used to engage a swing hanger with a support frame may be disposed on the support frame side, as opposed to the child support side (as in the preferred embodiment shown in FIGS. 7A–7D). For example, it is contemplated that a spring-biased latch may be disposed in operative proximity to a post of the support frame adapted for receiving a hanger arm of the child support. When the child support is to be mounted on the post, the latch is depressed (e.g., by applying continuous finger pressure to the latch) so as to allow clearance between the hanger connecting end and post. Once the hanger connecting end is clear of the latch, the latch is released, thereby securing the hanger connecting end. Such an alternative design approach is considered within the scope of invention.

As is apparent from the foregoing description, the preferred connection between hanger 70*a* and post 270 (as well as between hanger 70*b* and post 282) is not a mechanical connection in the conventional sense. Distal end 80 of hanger 70*a* is not mechanically coupled in either rotation or translation to post 270. Rather, post 270 is free to move within the space 80*a* defined by the walls of locking portion 102, member 88 and cap 82. This form of coupling can be thought of as an interference connection between distal end 80 and post 270. As illustrated in FIG. 7B and as described earlier, when latch 100 is closed, flange 278 will abut against member 88 and locking portion 102 if hanger 80 is pulled away from post 270, but may otherwise be freely repositioned along post 270 since space 80*a* provides a freedom of movement for hanger 80*a* relative to post 270. The connection can be thought of as an interference connection since the locking portion 102, member 88, wall 84 interfere with flange 278 if distal end 80 is pulled away from post 270. This type of connection offers several advantages, as will now be explained.

Figure 7D:
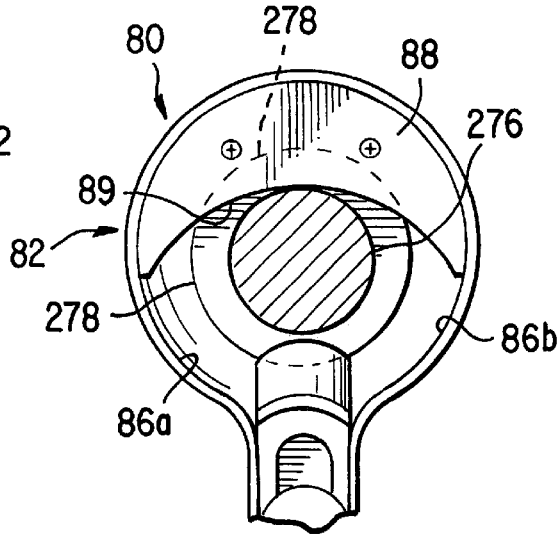
Figure 16A:
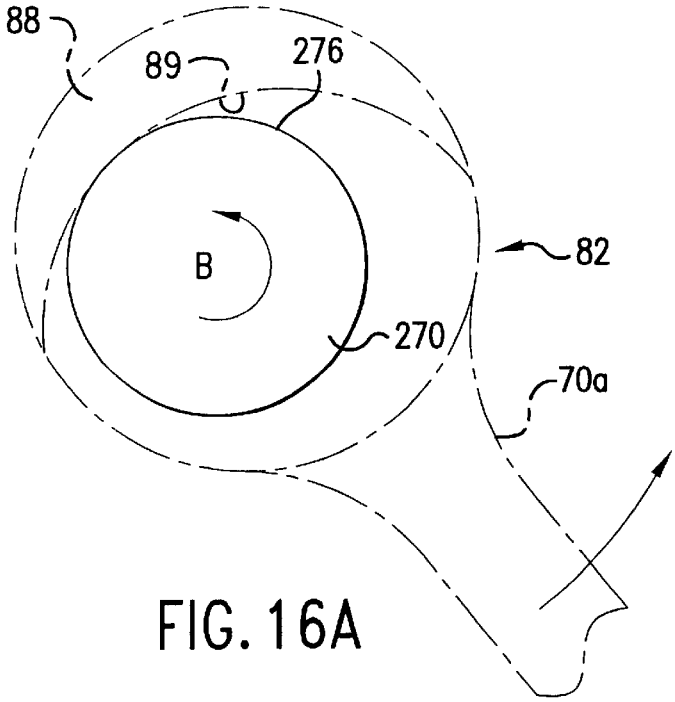
FIGS. 16A and 16B are partial plan views of a post of the left panel and arc member of the hanger shown as the child support rotates during use.
Figure 16B:
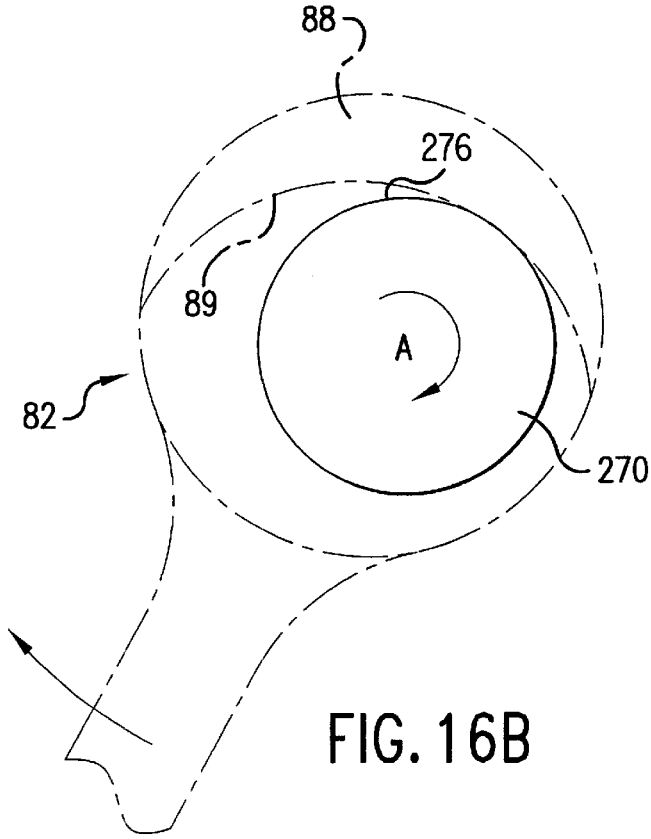

The interference fit between distal 80 and post 270 provides a convenient means for swing assembly since a connection between post 270 and distal 80 simply requires inserting post 270 into space 80. There are no fasteners needed to effectively couple distal end to post 270 during assembly, and the nature of the coupling allows a transfer of rocking motion from the drive assembly to child support 20 by simply inserting post 270 into space 80*a*. Referring to FIGS. 7B and 7D, child support 20 is supported by left frame 202 by suspending distal end 80 from post 270 and, in particular, by placing curved surface 89 of member 88 in contact with contact surface 276. This surface contact between distal end 80 and post 270 is relied upon to transfer rocking motion from post 270 to child support 20. FIGS. 16A and 16B illustrate the motion of distal end 80 relative to post 270 corresponding to rocking motion of child support 20. Preferably, the drive assembly supplying periodic motion causes post 270 to reverse rotational direction after completion of a cycle. Thus, the preferred means for supplying periodic motion includes a back and forth pivoting of post 270. The clockwise and counterclockwise rotation directions A and B, FIGS. 16A and 16B, respectively, represent the periodic motion of post 270 delivered from an output shaft of the drive assembly, which is rotatably coupled to post 270. As post 270 is pivoted back and forth, the frictional forces between contact surface 276 and curved surface 89 of member 88 are sufficient to cause post 270 to roll over curved surface 89 (as opposed to, e.g., a sliding surface contact between surface 89 and surface 276), the amount of roll being proportional to the angle of clockwise and counterclockwise rotation of post 270. The rolling motion of post 270 over surface 89 is preferably provided by forming surface 89 as a non-planar surface having a curvature that is less than the curvature describing surface 276. Although it is preferred to use a circular arc, it is understood that it is not necessary to use circular surfaces to achieve this rolling motion, since alternative pairs of cooperating surfaces could be formed to provide rolling motion. The frictional engagement which creates the rolling motion is preferably enhanced by disposing a material over post 270 that exhibits a relatively high coefficient of friction. In the preferred embodiment, a rubber sleeve 274 is used. Thus, contact surface 276 in the preferred embodiment corresponds to an outer surface of rubber sleeve 276. Other embodiments of cooperating engagement between post 270 and member 88 are possible. For example, contact surface 276 may describe a plurality of radially disposed teeth that engage matching teeth formed on member 88. In this embodiment, the engaging teeth can effectively create a rolling motion between post 270 and distal end 80 without reliance on maintaining frictional engagement, while still providing an interference-type fit as described above. In still another embodiment, surface 89 could, for example, describe a surface of a rectangularly shaped member disposed on cap 82 that is received in a rectangularly shaped recess formed on post 270.

Figure 9A:
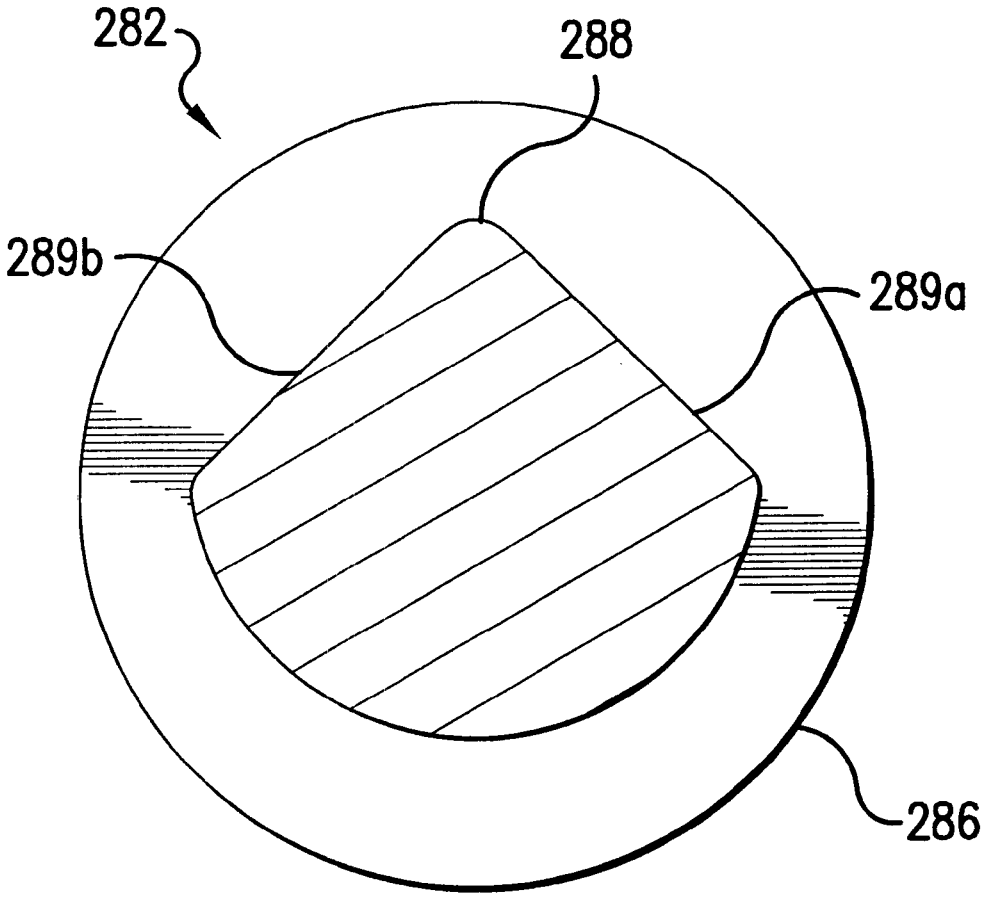
FIG. 9A is a plan view of a portion of the right panel of FIG. 9.
Figure 11:
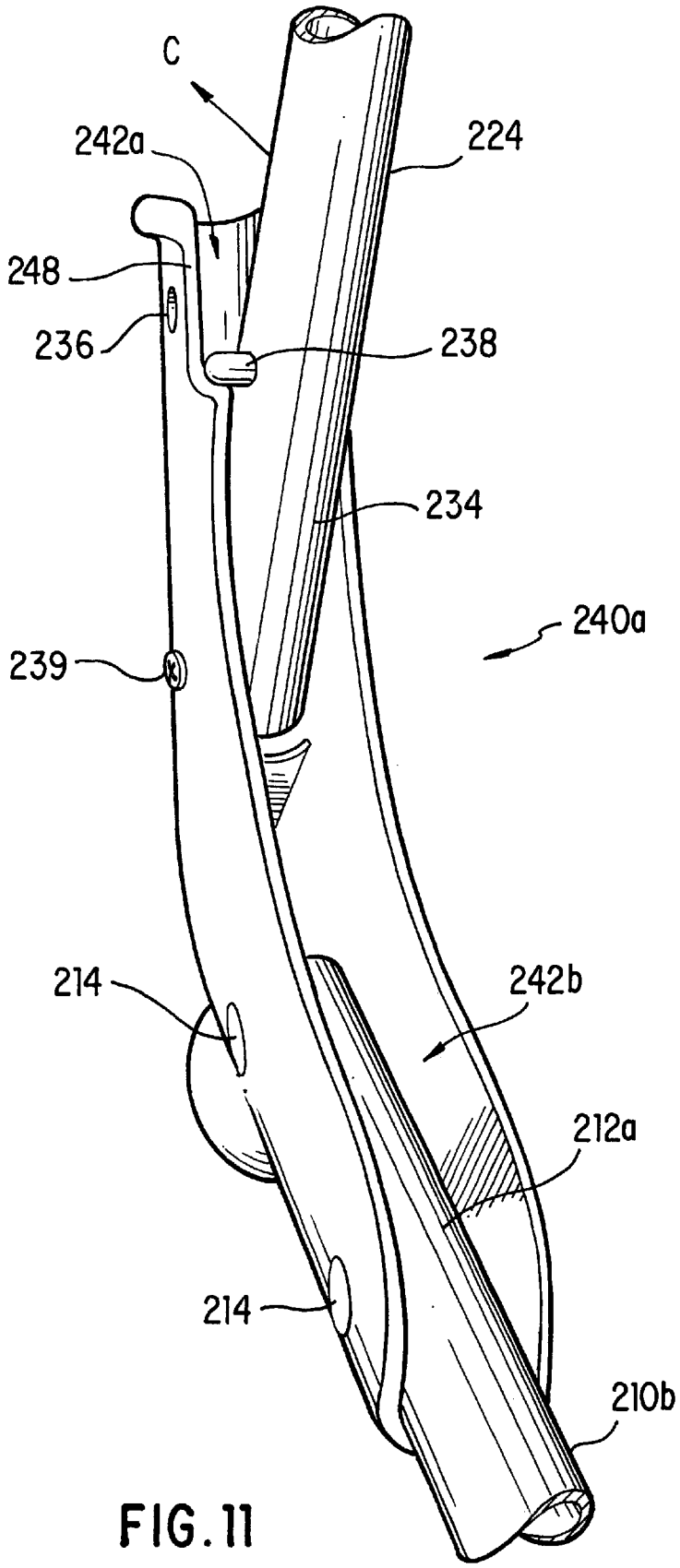
FIG. 11 is a perspective view of a foot of the frame of FIG. 8 in a partially folded position.

Referring to FIGS. 9 and 9A, right post 282 of right frame portion 204 is preferably non-cylindrical in shape. More specifically, right post 282 describes a lower end that is arcuate and an upper end describing a pair of planar surfaces converging to form an apex 288, as illustrated in the cross-sectional view of post 282 of FIG. 9A. When hanger 70*b* is connected to right post 282, distal end of hanger 70*b* is placed on apex 288. Apex 288 tends to minimize frictional engagement between post 282 and distal end 80 due to the minimal contact surface provided by apex 288. Thus, when rocking motion is transferred from the drive assembly to post 270 to impart the rolling motion between hanger 70*a*, distal end 80 and post 270 (as discussed above), the resulting rocking motion of support structure 20 produces a simple pivoting motion about apex 288. This results in a small amount of side-to-side displacement of head end 22 relative to foot end 24. The reduction of frictional engagement between post 282 and hanger 70*b* is advantageous in that there is a reduction in the tendency of stationary right frame post 282 to grip hanger 70*b*. It is preferred to reduce a gripping, or frictional engagement between post 282 and hanger 70*b* in order to reduce the instances of sliding surface contact between surface 89 of hanger 70*a* and surface 276 of post 270. Such a sliding surface contact can reduce the effectiveness of transferring pivoting motion of post 270 to hanger 70*a* in the manner described above. Of course, alternative forms for post 282 and hanger 70*b* may be employed to discourage slippage between surface 89 and contact surface 276. For example, a multi-axis rotational coupling (i.e., a rotational coupling that allows rotation about two or three axes, as opposed to a single axis rotational coupling) may be used to couple hanger 70*b* to panel 280 since such a connection reduce the resistance to rolling motion between hanger 70*a* and post 270.

Figure 8:
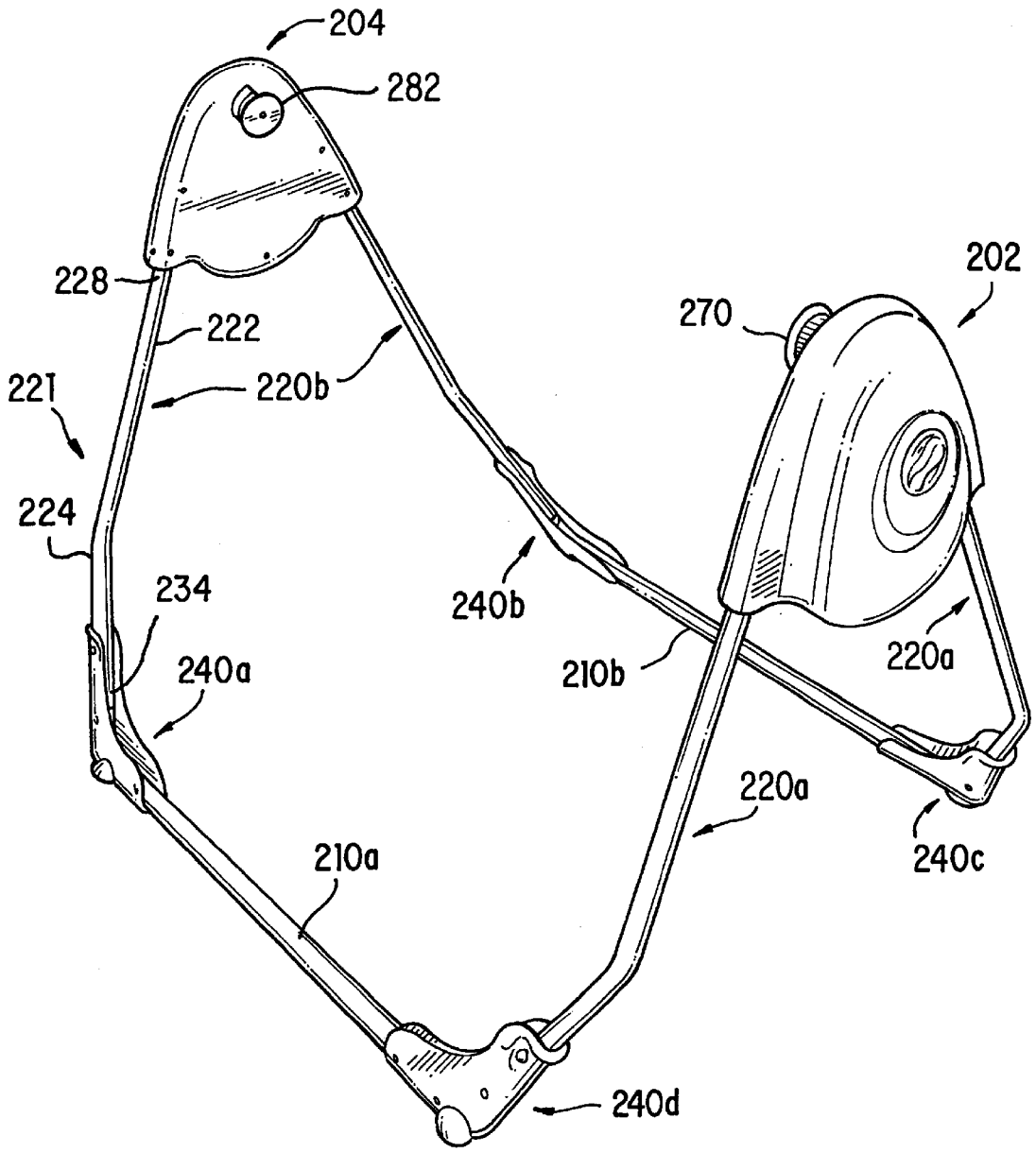
FIG. 8 is a perspective view of a frame of the swing of FIG. 1.

Referring to FIG. 8, frame 200 includes an identical pair of elongate base tubes 210*a*, 210*b*, each connected to left and right tube pairs 220*a*, 220*b*, respectively, by feet 240*a*, 240*b*, 240*c* and 240*d*. Each of the four tubes of left and right tube pairs 220*a*, 220*b* are identical and are preferably constructed from a hollow metal tube stock. Referring to tube 221 of right tube pair 220*b*, tube 221 includes a lower part 224 connected to an upper part 222 by a bend 221*a*, a lower end 234 connected to foot 240*a*, and an upper end 228 connected to right panel 280. Left and right tube pairs 220*a*, 220*b* are preferably formed with lower ends extending left and right from feet 240, respectively, to facilitate a more compact fold for frame 200 and yet provide a sufficient spacing between posts 282 and 270 for receiving child support 20 for swing use.

Feet 240*a*, 240*b*, 240*c* and 240*d* can be identical to each other. Referring to a partially folded view of frame 200 in the vicinity of foot 240*a*, FIG. 11, foot 240*a* is L-shaped and includes a first channel 242*a* for receiving lower end 234 of tube 221 and a second channel 242*b* for receiving left end 212*a* of base tube 210*b*. Base tube 210*b* is fixed to channel 242*b* by two rivets 214 extending through channel 242*b* and end 212*a*. Lower end 234 of tube 221 is connected to foot 240*b* by a bolt 239 extending through channel 242*a* and the terminal end of lower end 234. Tube 234 is pivotable about bolt 239 to allow tube 221 to be positioned between a folded position, FIG. 14, and a deployed position, FIG. 8. A spring biased button 238 is disposed in, and offset from the terminal end of lower end 234 to facilitate locking tube 221 in the deployed position. When configuring frame 200 from the folded position to the deployed position (i.e., as tube 221 is moved in direction C in FIG. 11), button 238 rides along a sloped engagement surface 248 formed in foot 240*b* to cause button 238 to displace inwardly into tube end 234. When tube 221 is fully received in channel 242*a*, button 238 is positioned over a hole 236 formed in foot 240*b* and extends through hole 236 by the restoring spring force biasing button 238 outward. When button 238 is fully extended through hole 236, tube 221*a* is locked in the deployed position. In the preferred embodiment, spring biased button 238 is a VALCO™ button.

Figure 10:
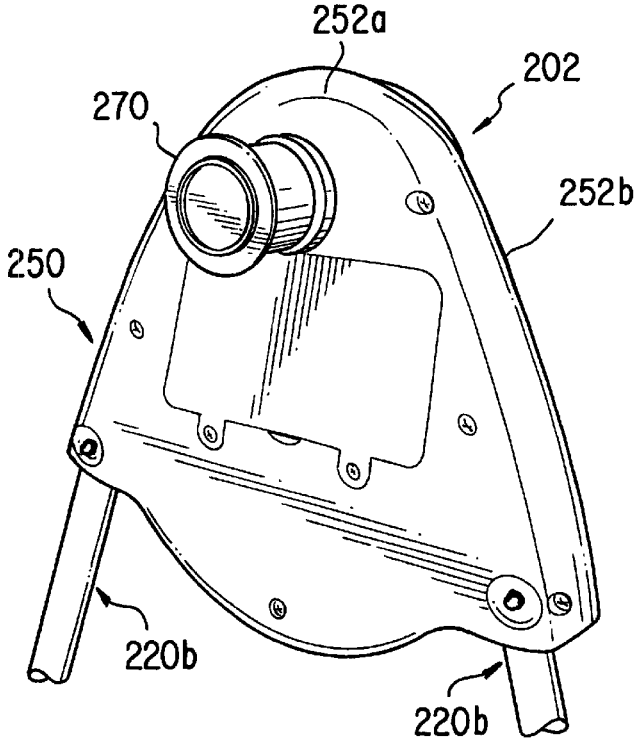
FIG.10 is a perspective view of a left panel of the frame of FIG. 8.
Figure 12:
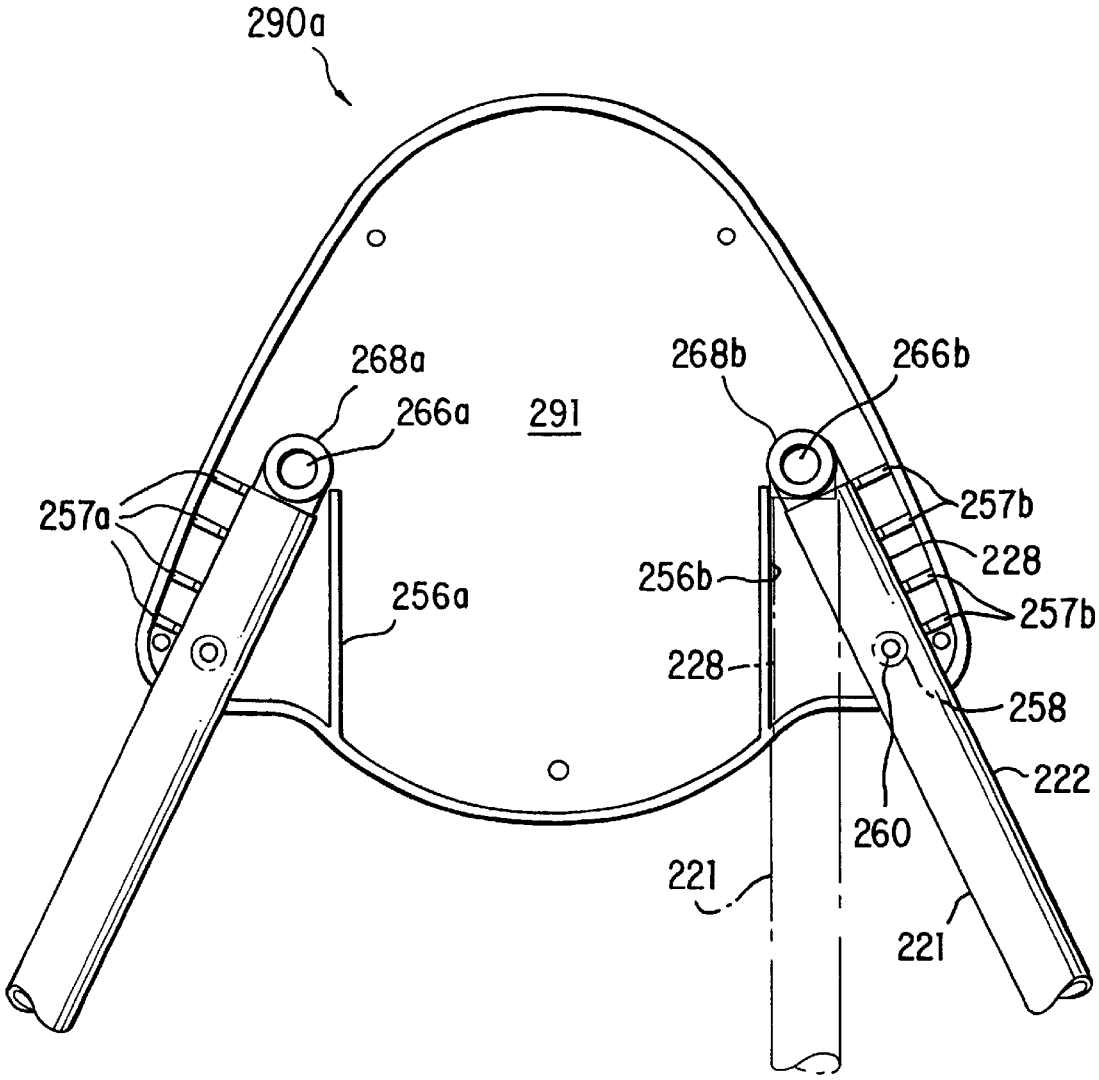
FIG. 12 is a plan view of a first housing of a panel of the frame of FIG. 8.

Referring to FIGS. 9 and 10, left panel 202 includes opposed housings 252*a*, 252*b* and right panel 204 includes similarly-shaped opposed housings 290*a*, 290*b*. Housings 252*a*, 252*b* and 290*a*, 290*b* are secured to each other by removable fasteners. Disposed on inner housings 252*a*, 290*a* (i.e., the housings facing each other when frame 200 is in the deployed position, FIG. 8) are posts 270 and 282, respectively. Post 282, which can be fixed relative to panel 204 (as mentioned above), is preferably formed on inner housing 252*a*. Post 270, which pivots during swing use, is rotatably coupled to panel 202 through the drive assembly (as mentioned above). The connectivity between panels 204 and 202 and the respective upper ends of tube pairs 220*a* and 220*b*, respectively, are the same. Therefore, reference will be limited to right panel 204 with the understanding that the same description of the connectivity between panel 202 and tube pair 220*a* applies to panel 202. Referring to a plan view of panel 204 with outer housing 290*b* removed, FIG. 12, and the perspective view of FIG. 9, left and right ribs 257*a*, 257*b*, and a left and right wall 256*a*, 256*b* are formed on housing and extend outward from surface 291 of housing 290*a*. A pair of left and right posts 266*a*, 266*b* are also formed on housing 290*a* and extend outward from surface 291. Rings 268*a*, 268*b* are disposed at the terminal ends of each of the tubes of tube pair 220*b*, which are received in the respective spaces defined by ribs 257*a*, 257*b* and walls 256*a*, 256*b*, as illustrated in FIG. 12. Rings 268*a*, 268*b* are adapted for receiving posts 266*a*, 266*b*. Each tube of tube pair 220*a* rotates about posts 266*a*, 266*b* between the deployed position, FIG. 12 and a stowed position, FIG. 13A. The portion of housing 290*a* associated with each tube of tube pair 220*a* is identical, as can be seen in FIG. 12,. Therefore, reference will be limited to the structure associated with upper part 222 of tube 221. When tube 221 is in the deployed position, upper end 228 abuts ribs 257*b*. A spring biased button 260*b*, disposed on upper end 228 and at a location offset from ring 268*b* (as shown in phantom in FIG. 12), is used to lock tube 221 in the deployed position. When tube 221 is in the deployed position, spring biased button 260*b*, which is preferably a VALCO™ button, extends through a hole 258 formed in housing 290*a* (as shown in FIG. 9). When configuring tube 221 in the stowed position, button 260*b* is depressed so as to clear button 260*b* from hole 258. Once button 260*b* is clear of hole 258, tube 221 may be pivoted about post 266*b* to the stowed position (as shown in phantom, FIG. 12). When in the stowed position, tube upper end 228 abuts against wall 256*b*.

Figure 13A:
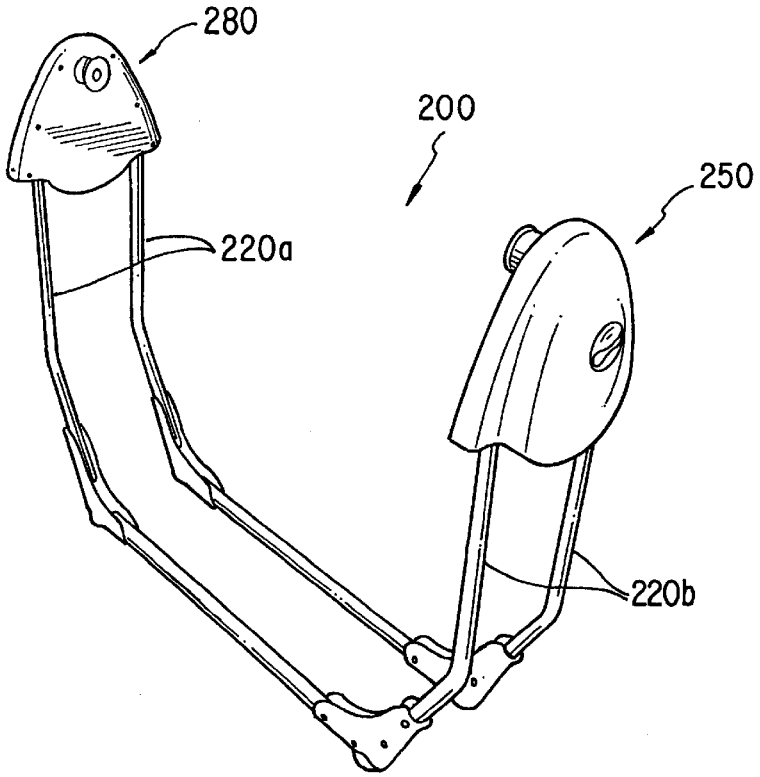
FIGS. 13A and 13B are perspective views of the frame of FIG. 8 in partially folded positions.
Figure 13B:
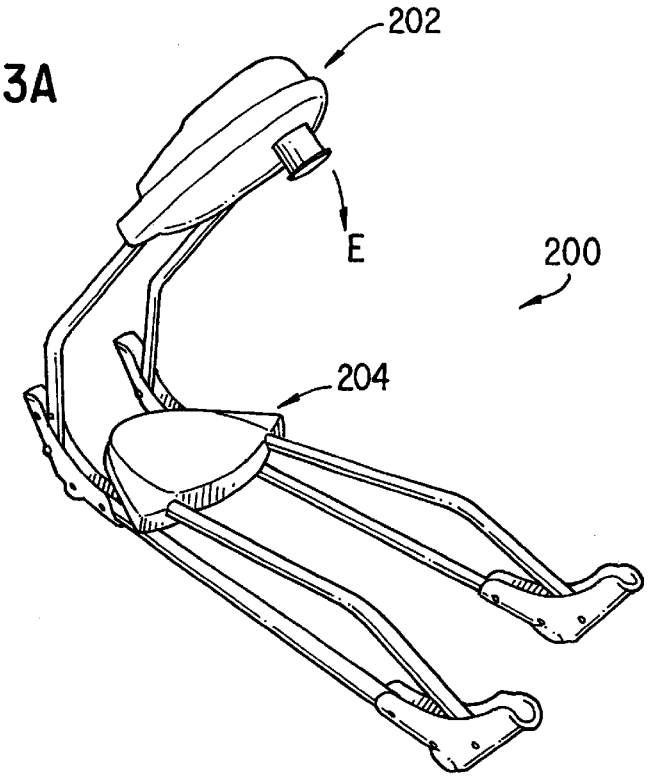

Referring to FIGS. 13A and 13B, frame 200 is preferably folded by a two-part operation. First, each tube of left and right tube pairs 220 are released from panels 280, 250 by release of the corresponding spring biased button (e.g., upper end 228 of tube 221 is released from its locked position by depressing button 260*b* so as to clear button 260*b* from hole 258, as described above). Each tube of tube pairs 220*a*, 220*b* may then be rotated toward each other so as to configure frame 200 in a partially folded configuration, FIG. 13A. Next, the spring biased buttons locking each tube of tube pairs 220*a*, 220*b* to feet 240 are released from the corresponding holes formed in the respective feet 240*a*, 240*b*, 240*c* and 240*d* (e.g., lower end 234 of tube 221 is released from its locked position by depressing button 238 so as to clear button 238 from hole 236, as described above). Left frame portion 202 and right frame portion 204 may then be rotated downward, e.g., in the direction E in FIG. 13B, to configure frame 200 in a fully folded configuration, FIG. 14.

Figure 14:
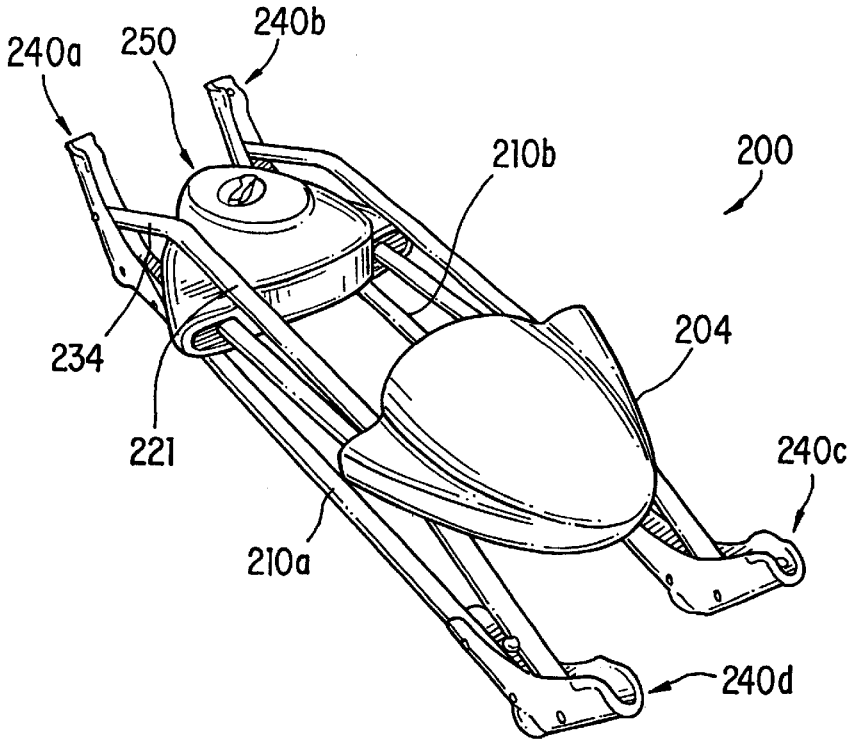
FIG. 14 is a perspective view of the frame of FIG. 8 in a fully folded position.
Figure 15:
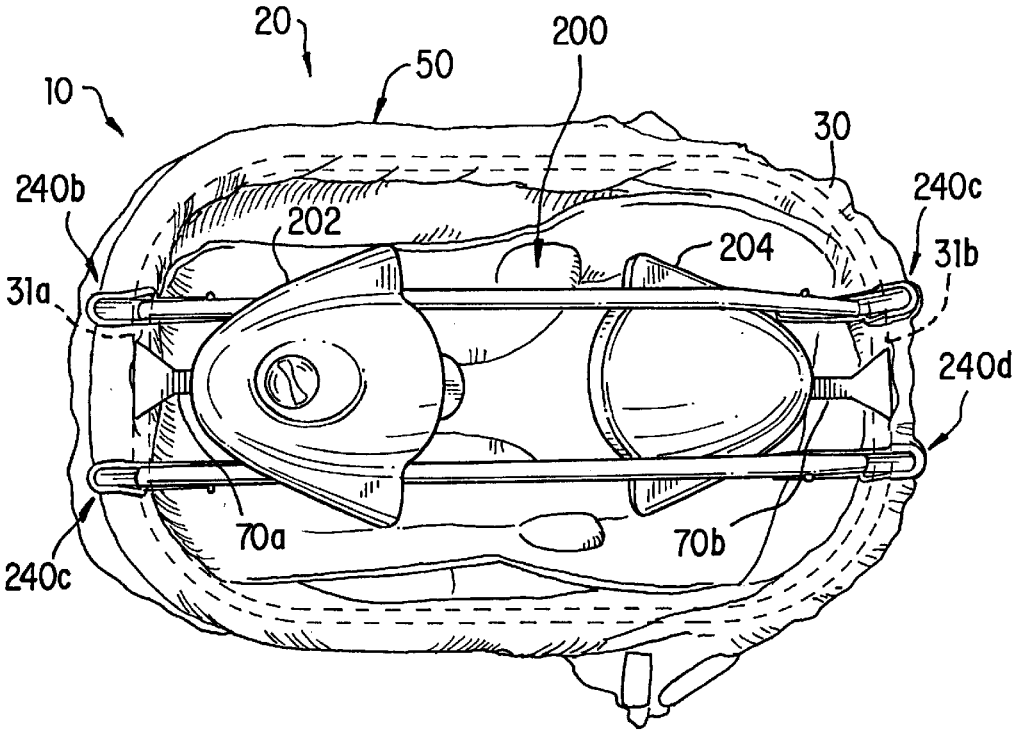
FIG. 15 is a plan view of the swing of FIG. 1 in a compact configuration.

As can be seen by appreciated by reference to FIGS. 14 or 15 (folded frame 200) with FIG. 8 (deployed frame 200), when in the folded position, the overall length of frame 200 is less than when frame 200 is in the deployed position. More specifically, the folded length of frame 200 is approximately equal to the length of base tubes 210*a*, 210*b*, whereas the deployed length of frame is approximately equal to the length tubes 210*a*, 210*b* plus the additional length provided by using outwardly extending tubes for left frame portion 202 and right frame portion 204 (e.g., lower part 224 of tube 221). FIG. 15 shows swing 10 configured in a stowed position. In the stowed position, child support 20 is collapsed and hangers 70*a*, 70*b* are placed within rim 30. The folded frame 200 may then be conveniently placed in the collapsed child receptacle 50. When configured in this manner, swing 10 is easily storable in a carrying case.

Figure 17:
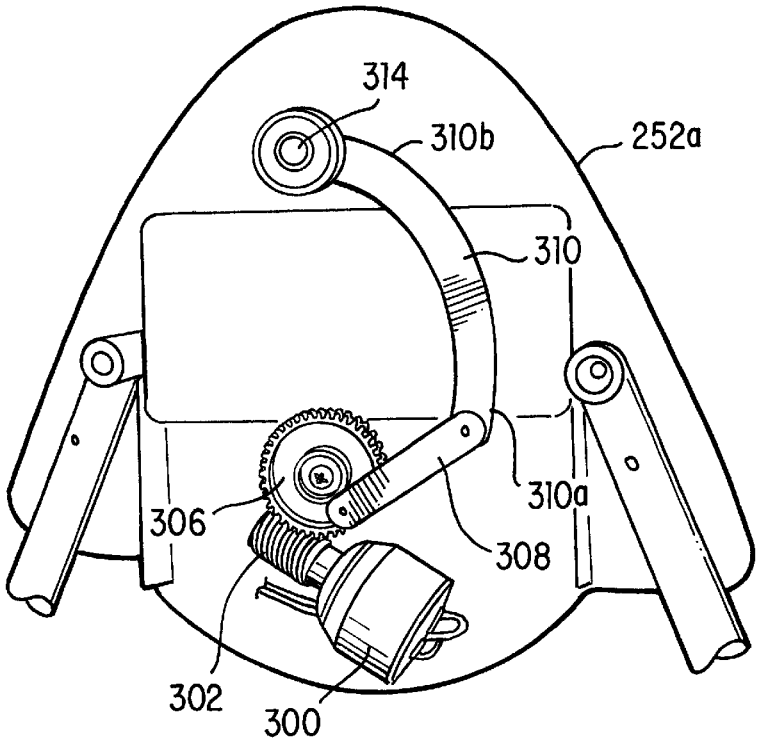
FIG. 17 is a plan view of the drive assembly of the swing of FIG. 1.

A preferred drive assembly will now be described. Referring to FIG. 17, drive assembly 300 is mounted to housing 252*a* of panel 250. An electric motor 300 is powered by a power supply (e.g., replaceable batteries) and is configured to drive a worm gear 302. An output shaft 314 of drive assembly 300 is coupled to post 270 to impart pivoting motion (as discussed earlier). The gear train coupling rotary output at worm gear 302 to pivoting motion of output shaft 314, and thus to post 270, includes a rotary gear 306 engaged with worm gear 302 and coupled to a linkage 308 and a pivot arm 310 as shown in FIG. 17. As worm gear 302 rotates, rotation of rotary gear 306 imparts a pivoting motion to pivot arm 310 through linkage 308, which is connected to pivot arm 310 at first end 310*a*. Pivot arm 310, secured to output shaft 314 at second end 310*b*, will then impart a back and forth pivoting motion to output shaft 314. Other types of drive assemblies may be used in place of drive assembly 300.

Figure 18:
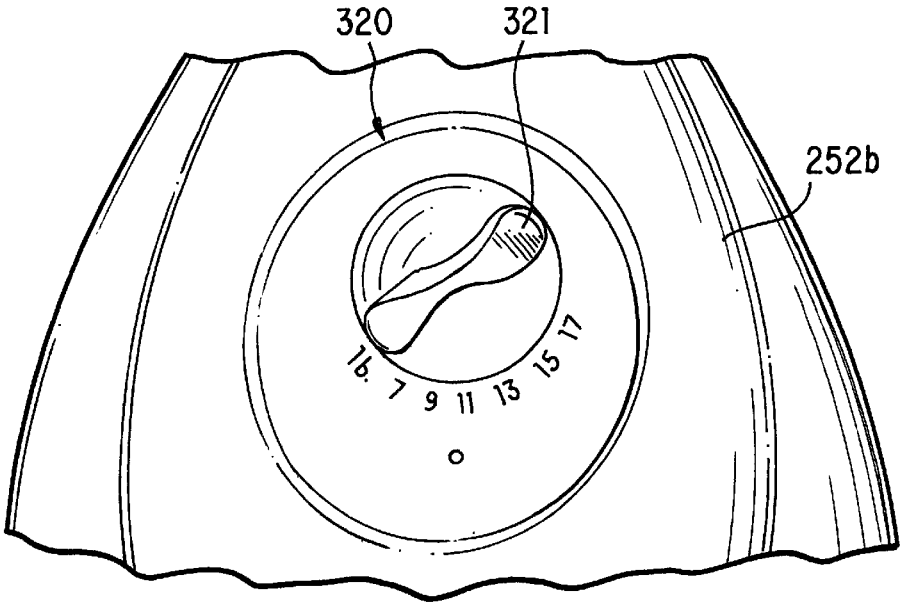
FIG. 18 is a front view of a left panel of the frame of FIG. 8 showing a voltage control for the drive assembly of FIG. 17.

In the preferred embodiment, periodic input from drive assembly 300 to child support 20 is controllable by a power control 320. Referring to FIG. 18, power control 320 allows a user to adjust the input voltage to motor 300 so as to vary the input torque provided by drive assembly 300 to child support 20. Power control 320 includes a user actuated dial 321 disposed on housing 252*b* for selecting between high and low input levels. As shown in FIG. 18, in the preferred embodiment the voltage setting appropriate for use depends on the weight of the child placed in swing 10 (e.g. a 7,9 or 11 lb. child). For heavier children, the input torque provided by drive assembly 300 is increased over the torque provided for a lighter child in order to achieve the same swinging motion. Of course, power control 320 also provides a user with the ability to adjust the swing rate or swing arc for the same weight child.

Examples of use for swing 10 will now be discussed. During use, power control 320 is adjusted by dial 321 according to the weight of the child. If, during use, a parent wishes to temporarily suspend swinging motion (e.g., to attend to the needs of the child), the parent may simply hold hanger 70*a* since this action will cause surface 89 to be removed from and/or slide relative to contact surface 276 of post 270 without causing damage to the drive assembly 300. This is yet another advantage of the child support-to-frame coupling described earlier. In contrast to most existing swings, a parent need not turn the motor off to stop swinging motion. Moreover, a parent can control, by hand, the swinging motion while the drive assembly is energized, thereby providing the parent with the ability to more fully interact with the child placed in the swing.

What is claimed is:

1. A swing for a child, said swing including a child support having a first end, a second end, and a support surface for supporting a child, the child support being adapted for rotating about an axis of rotation, said swing comprising:

a support frame including a first and second upstanding frame portion, the child support being supported upon said first and second frame portion;

a first coupling adapted for providing periodic motion output supplied by a motor drive assembly to the child support, said first coupling including:

a bearing member of said motor drive assembly, wherein the periodic output of the motor drive assembly is output at said bearing member, said bearing member including a bearing surface, and a mating member including a mating surface, wherein the child support is supported upon said first frame portion by engagement of a portion of said bearing surface with a corresponding portion of said mating surface, wherein when the child support first end is supported upon said first frame portion, said mating member is adapted for being rolled about said bearing member so as to displace said mating member along a displacement axis relative to said bearing member, said displacement axis being substantially perpendicular to the rotation axis; and a second coupling for supporting the second end upon said second frame portion;

wherein when said motor drive assembly produces periodic output at the bearing member, the child support rotates about the rotation axis by the rolling of said mating member about said bearing member.

2. The swing of claim 1, wherein said bearing member is mechanically decoupled from said mating member in a displacement direction corresponding to displacement along said displacement axis and in a rotation direction corresponding to rotation about the rotation axis.

3. The swing of claim 2, wherein said bearing member being mechanically decoupled from said mating member in said displacement and said rotation directions and the child support rotating about the rotation axis by the rolling of said mating member about said bearing member corresponds to a frictional engagement between said mating surface and said bearing surface sufficient to cause rotation of the child support about the rotation axis without said mating surface sliding along said bearing surface.

4. The swing of claim 2, wherein said bearing member rotates about the rotation axis when the child support rotates about the rotation axis and said bearing member is fixedly coupled to an output shaft of the motor drive assembly in a rotation direction corresponding to rotation about the rotation axis.

5. The swing of claim 4, wherein the motor drive assembly further includes, an electric motor having a drive shaft, and a power control for selectively adjusting the output from the drive shaft, wherein when a child having a weight is placed on the child support surface, the periodic output at the bearing member is adapted for being adjusted to accommodate the weight of the child by adjustment of the output from the drive shaft through said power control.

6. The swing of claim 1, wherein said portion of said mating surface corresponds to one of a plurality of sequentially spaced first contact surfaces describing an arcuate surface, wherein a portion of a cross-section of said bearing member describes an ellipsoidal shape, and wherein said portion of said bearing surface corresponds to one of a plurality of sequentially spaced second contact surfaces describing at least a portion of the outer surface of said ellipsoidal shaped cross-section, wherein said mating member being adapted for being rolled about said bearing member corresponds to one of said plurality of sequentially spaced first contact surfaces being in intermittent contact with a corresponding one of said plurality of sequentially spaced second contact surfaces as the child support rotates.

7. The swing of claim 6, wherein said bearing member is cylindrical in shape and said mating surface describes an arc of circle.

8. The swing of claim 1, wherein said bearing surface approximately describes a first arc of a circle defined by a first radius and said mating surface approximately describes a second arc of a circle defined by a second radius, said second radius being substantially greater than said first radius.

9. The swing of claim 1, wherein at least one of said bearing and mating surface is a tacky-like surface adapted for causing a frictional engagement between said mating surface and said bearing surface, said tacky-like surface being adapted for promoting said mating member being rolled about said bearing member.

10. The swing of claim 9, wherein said tacky-like surface corresponds to a rubber padding having a contact surface, said rubber padding being disposed on one of said bearing member and said mating member and said contact surface corresponding to a respective one of said bearing surface and mating surface.

11. The swing of claim 1, wherein the child support is adapted for being removed from said support frame by disengagement of said first and second couplings from the respective first and second frame portions, each of said first and second couplings including, a releasable latch adapted for engagement of a respective terminal end of the child support to a respective frame portion and removal of the child support from the respective frame portion.

12. The swing of claim 1, wherein said bearing member is rotatably coupled to the first end of the child support such that said bearing member is limited to rotation about the rotation axis when the child support rotates.

13. The swing of claim 1, wherein the child support being supported by said support frame consists of said first and second couplings supporting the child support upon said first and second frame portions.

14. A self-supporting child's swing supportable on a support surface and configurable between a storage and use position, comprising:

a frame configurable between a folded position and an unfolded position, said frame including a ground engaging portion, a first frame portion and a second frame portion, each of said frame portions being fixedly hinged to said ground engaging member, and a first and second housing, wherein when said frame is configured in said unfolded position, said first and second frame portions are configured in a first orientation relative to said ground-engaging member, and when said frame is configured in the folded position, said first and second frame portions are configured in a second orientation relative to said ground-engaging member, said second orientation corresponding to said first and second frame portions being rotationally offset from their respective first orientations; and a child support having a child support surface and describing a child receiving end, said child support being configurable between a deployed and stowed position, said child support including:

an annular support member defining an outer perimeter of the child receiving end and first and second terminal ends of said child support, a first connector and a second connector disposed at the respective first and second ends, and a child receiving portion secured to said support member, said child receiving portion including retaining walls and the child support surface, wherein when said child support is in the deployed position, said child support surface is disposed below said support member and the child support surface is contained within said retaining walls, and wherein when said child support is in the stowed position, said child support surface and said support member lie within approximately the same plane;

wherein when said self-supporting child's swing is in the use position, said child support is suspended from said first and second frame housings by the respective first and second connectors of said child support, said child support is in said deployed position, and said frame is in said unfolded position, and wherein when said self-supporting child's swing is in the storage configuration, said child support is configured in said stowed position, said frame is in said folded position and said folded frame is contained substantially within said child receiving end.

15. The self-supporting child's swing of claim 14, wherein each of said first and second connectors of said child support extend upwardly from said support member of said child support when said child support is in the deployed position and said first and second connectors lie approximately within the child receiving area when said child support is in the stowed position.

16. The self-supporting child's swing of claim 15, wherein each of said first and second connectors further include a distal end for connecting said child support to the respective first and second frame portions and a proximal end rotatably coupling said connectors to said support frame.

17. The self-supporting child's swing of claim 14, wherein said frame is a one-piece frame when configured in each of said folded and unfolded positions.

18. The self-supporting child's swing of claim 17, wherein when said frame is in said unfolded position, said first and second frame portions correspond to upstanding portions of said frame, each of which having a lower end fixedly hinged to said ground engaging portion and an upper end, said first and second housings being disposed at the respective first and second upper ends, wherein when said self-supporting child's swing is in the storage configuration, said first and second housings are disposed between the first and second terminal ends of said child support.

19. The self-supporting child's swing of claim 14, wherein said first end of said child support corresponds to a head end and said second end corresponds to a foot end, said head end and foot end corresponding to a head support portion and foot support portion of the child support surface.

20. The self-supporting child's swing of claim 14, wherein a first length is defined as the distance between the first and second ends of said child support, said frame having an unfolded length defined by the distance between said first and second frame portions when said frame is in the unfolded position, said unfolded length being greater than said first length, and said ground engaging portion of said frame is an elongate member having first and second terminal ends fixedly hinged to said first and second frame portions, respectively, the distance between said first and second terminal ends defining a folded length of said frame when said frame is in the folded position, said folded length being less than said first length.

21. The self-supporting child's swing of claim 20, wherein said first and second frame portions have a lower end fixedly hinged to the respective first and second terminal ends of said elongate member and an upper end, said first and second housings being disposed on the respective first and second upper ends, wherein when said self-supporting child's swing is in the storage configuration, said first housing is disposed adjacent said second frame portion lower end and said second housing is disposed adjacent said first frame portion lower end.

22. The self-supporting child's swing of claim 14, further including a motor drive assembly contained within said first housing, said motor drive assembly including an output member for transmitting periodic input to said child support, said output member being coupled to said first connector when said child's swing is configured in said use configuration.

23. The self-supporting child's swing of claim 22, wherein when said first connector is coupled to said output member by a self-locking latch.

24. The self-supporting child's swing of claim 14, wherein said child support surface has an upper body end and a lower body end, said child support surface being configurable between a first child support position and second child support position, said first child support position corresponding to said upper body end and lower body end lying in substantially the same plane, and said second child support position corresponding to said upper body end being inclined relative to said lower body end.

25. The self-supporting child's swing of claim 14, wherein said child receiving portion secured to said support member corresponds to said retaining walls being secured to said support frame and said child support surface being suspended from said retaining walls.

26. The self-supporting child's swing of claim 25, wherein said supporting frame is rigid and said retaining walls are made from soft goods.

27. A child swing configurable between a use position and a storage position, comprising:

a child support having first and second ends, said child support being supportable on first and second frame ends of a ground engaging support frame, said child swing being adapted for rotation of the child support about a rotation axis;

a first mounting member disposed at the first frame end, said first mounting member including an output member of a motor drive assembly mounted to the first frame end, the drive assembly being adapted for producing periodic motion of the output member, and a retainer disposed at a terminal end of said first mounting member;

a second mounting member disposed at the second frame end;

a first and second connecting arm of said child support, said first and second connecting arms being adapted for supporting said child support from the ground engaging support frame first and second ends, each of said first and second connecting arms including a proximal end coupled to the respective child support first and second end, and a distal end adapted for being connected to the respective first and second mounting members; and a first latch disposed at one of said distal end of said first connecting arm and said first frame end, said first latch including a blocking piece movable between an engaged and disengaged position;

wherein when said child swing is configured in the use position, said first connecting arm distal end is in contact with said output member so as to enable the periodic output from the motor drive assembly to rotate said child support and said first latch is in said engaged position so as to provide an interference fit between said distal end and said first mounting member, said interference fit preventing inadvertent removal of said first connecting arm distal end from said first mounting member when said child support rotates.

28. The swing of claim 27, said first latch is disposed at said distal end of said first connecting arm, said output member of said drive assembly having a contact surface, said first connecting arm distal end including a mating surface in contact with said contact piece when the child support rotates, and said first connecting arm distal end having an upper wall, lower wall, and left and right side walls, wherein said mating surface is disposed on said upper wall and said blocking piece is disposed on said lower wall, said upper wall, left and right side walls and lower wall describing a first opening when said blocking piece is in said engaged position, and a second opening when said blocking piece is in said disengaged position, and wherein said output member is receivable in said second opening and said output member is not receivable in said first opening.

29. The swing of claim 28, wherein when said mating surface is in contact with said contact surface and said blocking piece is in said engaged position, said distal end of said first connecting arm is freely displaceable along both a first direction substantially perpendicular to the rotation axis and second direction substantially parallel to the rotation axis.

30. The swing of claim 27, the first frame end having a wall and said output member extending outwardly from the wall and terminating at said terminal end and said retainer corresponding to a flange formed at the terminal end of said output member, wherein when said first latch is engaged, said interference fit corresponds to said first connecting arm distal end being non-removable from said output member and said distal end being freely displaceable between said flange and the first frame end wall.

31. The swing of claim 27, wherein said interference fit permits said distal end to be decoupled from said output member while the motor drive assembly is producing periodic output at the output member.

32. The swing of claims 27, wherein said blocking piece disengaged position disables said interference fit between said distal end and said mounting member and said disengaged position permits said distal end to be removed from said output member, wherein said first latch further includes a biasing spring of said blocking member, said biasing spring being adapted for automatically enabling said interference fit between said distal end and said mounting member when said distal end is connected to said output member.

33. The swing of claim 27, said first latch is disposed at said distal end of said first connecting arm, wherein said first latch is a self-locking latch and said blocking piece includes a sloped surface adapted for configuring said first latch from said engaged position to a disengaged position by engagement of said sloped surface with a corresponding surface of said retainer.

34. The swing of claim 27, wherein said distal end includes a cap having an opening, wherein said blocking piece engaged position corresponds to said blocking piece extending into said opening and said blocking piece disengaged position corresponds to said blocking piece being removed from said opening, wherein said mounting member is insertable into said cap opening when said blocking piece is in said disengaged position.

35. The swing of claim 27, wherein said first frame end has a wall and said output member extends outwardly from said wall, wherein when said distal end is connected to said output member, said blocking piece is disposed between said retainer and said wall.

36. The child swing of claim 27, wherein said output member describes a generally arcuate surface in contact with said first distal end and wherein said second mounting member includes a surface placed in contact with said second connecting arm distal end when said second connecting arm distal end is connected to said second mounting member, said surface describing an apex formed from a pair of converging surfaces.

37. The child swing of claim 27, further including a second latch disposed at one of said distal end of said second connecting arm and said second frame portion, said second latch including a blocking piece adapted for being moved between an engaged and disengaged position.

38. The child swing of claim 37, said first and second latches further including respective first and second finger tabs, said finger tabs being operative for moving said latches between their respective engaged and disengaged positions.

39. A method for configuring a child's swing from a use position to a storage position, the child's swing including a child support suspended from a frame when in the use position, the child support including a child support surface, first arm and second arm located at a head and foot end of the child support, respectively, the first and second arms including a respective first and second latch and the child support including a rim support having an outer perimeter that is approximately equal to an outer perimeter of the child support surface, the child support surface being contained within collapsible walls and suspendable from the rim support, the frame having frame members connected by hinges, a first end and a second end and the frame including a motor drive assembly mounted to the first end, wherein when the child's swing is configured in the use position, the first arm is suspended from the first end and the second arm is suspended from the second end, comprising the steps of:

removing the first arm of the child support from the first end of the frame;

removing the second arm of the child support from the second end of the frame;

folding the frame, consisting of the step of rotating the frame members about the hinges;

collapsing the walls of the child support, wherein when the child support walls are collapsed, the child support surface lies in approximately the same plane as the child support rim support; and placing the folded frame within the rim support.

40. The method of claim 39, wherein each of said removing the first arm from the first end and said removing the second arm from the second end steps includes the step of disengaging a latch retaining the respective arm on the end so as to permit said removing the respective arm from the end.

41. The method of claim 40, wherein each of said disengaging the latch steps further includes manually depressing a finger tab disposed on each of the first and second latches.

42. The method of claim 39, wherein said folding the frame step further includes the step of placing the first end on the second end.

43. The method of claim 39, wherein the first end and the second ends each include respective first and second upper housing portions, wherein said placing the folded frame within the rim support further includes the step of placing the first upper housing portion adjacent to the head end and the second upper housing portion adjacent to the foot end.

44. The method of claim 39, wherein said collapsing the child support further includes the steps of folding the first and second arms so as to position the first and second arms within the rim support.

45. A swing assembly, said swing assembly being adapted for use by a child and being configurable between a collapsed and use position, comprising:

a child carrier including a supporting surface for supporting the child thereon and an ellipsoidal-like frame member providing an opening for receiving the child on the support surface, said frame member defining first and second ends of said child carrier and said support surface being disposed below said frame member;

a support structure including first and second end portions adapted for supporting said child carrier;

a first and second relatively rigid and elongate connecting arm coupled to said child carrier first and second ends, respectively, said connecting arms further including a proximal end rotatably coupling said connecting arm to said child carrier end, said proximal end being adapted for configuring said connecting arm between a deployed position wherein said connecting arm extends upwardly from said child carrier, and a stowed position wherein said connecting arm lies substantially within said opening defined by said frame member, a distal end adapted for rotatably coupling said child carrier to the respective upstanding end portions of said support structure;

wherein when said swing assembly is in the collapsed position, said first and second distal ends are decoupled from said support structure end portions and said first and second connecting arms are configured in the respective stowed positions.

46. The swing assembly of claim 45, wherein each of said first and second connecting arms include a latch disposed at said distal end, said latch being configurable between an open and closed position, wherein when said latch is in said closed position and said distal end is rotatably coupled to said end portion.

47. The swing assembly of claim 46, wherein each of said support frame end portions include an extension for receiving the respective distal ends of said connecting arms, said extensions each including a retention flange disposed at a terminal end of said extension, said distal end being receivable upon said extension when said latch in said open position and wherein each of said first and second latches are a self-locking latch, including a finger tab for manually moving said latch from said closed to said open position when said distal end is to be removed from the respective end portion, a cam surface adapted for coupling said distal end to said extension by engagement of said cam surface with said retention flange so as to cause said latch to move from said closed to said open position, and a biasing spring for biasing said latch to said closed position.

48. The swing assembly of claim 45, wherein said frame member and connecting arms are adapted for being configured into a substantially flat position, said substantially flat position corresponding to said frame member and connecting arms being substantially contained within a first plane and wherein said child carrier is configurable in a compact position, child carrier including a collapsible receiving portion suspended from said frame member, said receiving portion defining said child support surface, wherein when said swing is in the collapsed position, said child carrier is configured in said compact position corresponding to said child support surface, connecting arms and said frame member lying substantially within the same plane as said first plane.

49. The swing assembly of claim 48, wherein said collapsible receiving portion includes a fabric wall and said child support surface includes battens received within fabric sleeves of said collapsible receiving portion.

* * * * *